US009797404B2

(12) United States Patent
Karst et al.

(10) Patent No.: US 9,797,404 B2
(45) Date of Patent: Oct. 24, 2017

(54) SPEAKER FAN SYSTEM AND METHOD

(71) Applicant: Broan-NuTone LLC, Hartford, WI (US)

(72) Inventors: Daniel L. Karst, Beaver Dam, WI (US); Benjamin Thorpe Puffer, Hartford, WI (US); Brent Elliott Coffey, Pewaukee, WI (US)

(73) Assignee: BROAN-NUTONE LLC, Hartford, WI (US)

( * ) Notice: Subject to any disclaimer, the term of this patent is extended or adjusted under 35 U.S.C. 154(b) by 354 days.

(21) Appl. No.: 14/533,430

(22) Filed: Nov. 5, 2014

(65) Prior Publication Data

US 2015/0125292 A1 May 7, 2015

Related U.S. Application Data

(60) Provisional application No. 61/900,281, filed on Nov. 5, 2013.

(51) Int. Cl.
*F04D 25/12* (2006.01)
*F24F 7/013* (2006.01)
(Continued)

(52) U.S. Cl.
CPC ..... *F04D 25/12* (2013.01); *F04D 25/166* (2013.01); *F04D 29/282* (2013.01);
(Continued)

(58) Field of Classification Search
CPC ..... F04D 25/08; F04D 25/088; F04D 25/12; F04D 25/14; F04D 25/166; F04D 29/282;
(Continued)

(56) References Cited

U.S. PATENT DOCUMENTS 1,722,824 A 7/1929 Roethel
2,588,086 A 3/1952 Cole
(Continued)

FOREIGN PATENT DOCUMENTS

CN 201502556 6/2010
CN 101881503 11/2010
(Continued)

OTHER PUBLICATIONS

"English Translation of JP61065092A to Yuzo Apr. 3, 1986", 3 pgs.
(Continued)

*Primary Examiner* — Dwayne J White
*Assistant Examiner* — Peter T Hrubiec
(74) *Attorney, Agent, or Firm* — McDermott Will & Emery LLP

(57) ABSTRACT

A ventilation assembly having a main housing that can be pre-installed in a wall or ceiling aperture. A fan assembly can be inserted through the aperture and releasably mounted within the main housing. The fan assembly can be removed from the main housing and replaced without removing the main housing from the wall or ceiling. An accessory component can be releasably mounted to the fan assembly either through the aperture when the fan assembly is mounted or prior to installation of the fan assembly.

23 Claims, 22 Drawing Sheets

(51) Int. Cl.

| | |
|---|---|
| ***F04D 25/16*** | (2006.01) |
| ***F04D 29/28*** | (2006.01) |
| ***F04D 29/60*** | (2006.01) |
| ***F24F 13/20*** | (2006.01) |
| ***F04D 29/70*** | (2006.01) |

(52) U.S. Cl.
CPC ..... *F04D 29/602* (2013.01); *F24F 7/013* (2013.01); *F24F 13/20* (2013.01); *F04D 29/703* (2013.01); *F24F 2221/18* (2013.01); *F24F 2221/36* (2013.01); *Y10T 29/49327* (2015.01)

(58) Field of Classification Search
CPC .... F04D 29/602; F04D 29/626; F04D 29/646; F04D 29/4226; F04D 29/703; F24F 7/007; F24F 7/013; F24F 7/06; F24F 13/20; F24F 2221/18; F24F 2221/36
USPC ..... 415/213.1
See application file for complete search history.

(56) References Cited

U.S. PATENT DOCUMENTS

| | | | | |
|---|---|---|---|---|
| 2,612,830 | A | 10/1952 | Kendrick | |
| 2,613,757 | A | 10/1952 | Melzer | |
| 2,683,407 | A | 7/1954 | Takach | |
| 3,165,587 | A | 1/1965 | Alderson | |
| 3,927,316 | A | 12/1975 | Citta | |
| 4,371,814 | A | 2/1983 | Hannas | |
| 4,528,620 | A | 7/1985 | Weber | |
| 5,343,713 | A | 9/1994 | Okabe et al. | |
| 5,410,735 | A | 4/1995 | Borchardt et al. | |
| 5,664,872 | A | 9/1997 | Spearman et al. | |
| 5,884,694 | A | 3/1999 | Tanenbaum | |
| 5,980,057 | A | 11/1999 | Christie | |
| 6,215,885 | B1 | 4/2001 | Geiger | |
| 6,466,832 | B1 | 10/2002 | Zuqert et al. | |
| 6,577,081 | B2 | 6/2003 | Dickie | |
| 6,580,228 | B1 | 6/2003 | Chen et al. | |
| 6,731,761 | B1 | 5/2004 | Zablocki et al. | |
| 7,076,204 | B2 | 7/2006 | Richenstein et al. | |
| 7,455,500 | B2 * | 11/2008 | Penlesky ..... | F04D 29/4226 415/206 |
| 7,535,341 | B2 | 5/2009 | Haase | |
| 7,606,379 | B2 | 10/2009 | Ivey et al. | |
| 7,844,060 | B2 | 11/2010 | Zulkowski | |
| 7,862,371 | B1 | 1/2011 | Johnson | |
| 8,042,961 | B2 | 10/2011 | Massara et al. | |
| 8,249,731 | B2 | 8/2012 | Tran et al. | |
| 8,620,016 | B2 | 12/2013 | Belanger et al. | |
| 8,625,833 | B1 | 1/2014 | Armwood | |
| 8,763,750 | B1 | 7/2014 | Berkman et al. | |
| 8,770,949 | B2 | 7/2014 | Noble | |
| 2005/0078837 | A1 | 4/2005 | Hornback | |
| 2008/0064318 | A1 * | 3/2008 | Wellner ..... | F24F 13/078 454/292 |
| 2008/0298045 | A1 | 12/2008 | Wright | |
| 2009/0067663 | A1 | 3/2009 | Ivey et al. | |
| 2012/0274767 | A1 | 11/2012 | Hornback | |
| 2012/0313553 | A1 | 12/2012 | Ko | |
| 2013/0062437 | A1 | 3/2013 | Hanna et al. | |
| 2013/0084793 | A1 | 4/2013 | Yang et al. | |

FOREIGN PATENT DOCUMENTS

| | | |
|---|---|---|
| CN | 202092255 | 12/2011 |
| CN | 202613644 | 12/2012 |
| GB | 2471069 | 12/2010 |
| JP | 61065092 | 4/1986 |
| JP | 06305325 | 11/1994 |
| JP | 2005127688 | 5/2005 |
| JP | 2005171838 | 6/2005 |
| JP | 20070010078 | 1/2007 |
| JP | 2007240124 | 9/2007 |
| JP | 2008164206 | 7/2008 |
| JP | 2008190764 | 8/2008 |
| JP | 2008190765 | 8/2008 |
| JP | 2009228954 | 10/2009 |
| JP | 2010071475 | 4/2010 |
| JP | 2010190506 | 9/2010 |
| JP | 2011094893 | 5/2011 |
| KR | 20040013864 | 5/2004 |
| KR | 20090063326 | 6/2009 |
| PH | 22006000151 | 2/2007 |
| WO | 2007083877 | 7/2007 |

OTHER PUBLICATIONS

"New Battistinis Harley-Davidson Speaker Grill Covers", Jul. 23, 2010. URL: http://cyrilhuzeblog.com/2010/07/23/new-battistinis-harley-davidson-speaker-grill-covers/.
"What is the difference between Bluetooth technology and Wi-Fi?", Oct. 22, 2011. URL: http://www.bluetooth.com/Pages/Wi-Fi.aspx.
"Lighting California's Future: Smart Light-Emitting Diode Lighting in Residential Fans", Mar. 2003. Pier Final Project Report, California Energy Commission, CEC-500-2011-018.

* cited by examiner

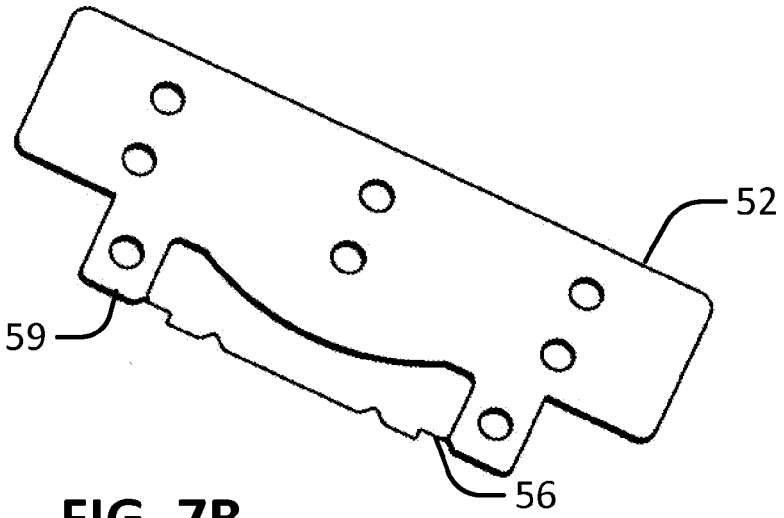
FIG. 7B
FIG. 7C
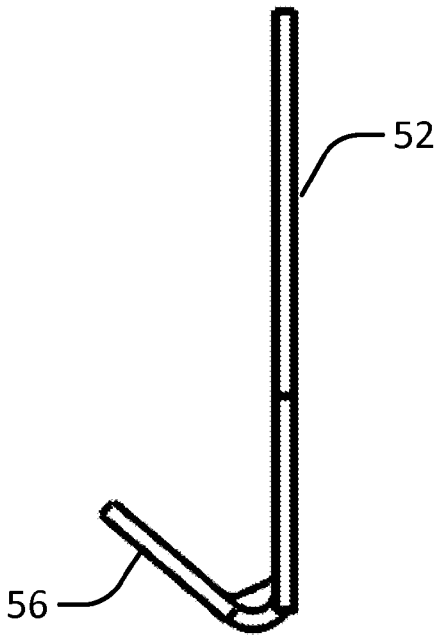

SPEAKER FAN SYSTEM AND METHOD

CLAIM OF PRIORITY

This patent application claims the benefit of priority, under 35 U.S.C. Section 119(e), to Daniel L. Karst, et al. U.S. Patent Application Ser. No. 61/900,281, entitled "SPEAKER FAN SYSTEM AND METHOD," filed on Nov. 5, 2013, each of which is hereby incorporated by reference herein in its entirety.

TECHNICAL FIELD

This document pertains generally, but not by way of limitation, to a ventilation system having a modular fan assembly and an accessory component.

BACKGROUND

Ventilating exhaust fans, such as those typically installed in bathrooms, draw air from within a space and pass the exhausted air out to another location, such as by passing the exhausted air through a vent in the gable or roof of a building. Exhaust fans can include a rotating fan wheel having a plurality of vanes that are rotated in a housing to draw an inward airflow from the space through a housing inlet and push an outward airflow through a housing outlet to the other location. Exhaust fans are typically mounted in an aperture of a wall or ceiling of the structure separating the space and the other location by mounting the housing to wall or ceiling joists or other structure in the wall or ceiling.

The location within the wall or ceiling and structure of exhaust fans makes exhaust fans attractive for the inclusion of other user functions that could benefit from the position of the exhaust fans with respect to the user and/or the convenient availability of a user-remote power source. However, most commercially available fans only have ventilation functionally or limited integrated lighting. Moreover, the mounting of the housing within the wall or ceiling aperture makes removing and replacing an installed ventilation fan to install additional functions or generally repair the fan difficult and time consuming. The removal and replacement of the exhaust fan can also require dis-connection and re-connection of the building power supply and installed ductwork for conveying air to and away from the exhaust fan further complicating the replacement process.

OVERVIEW

The present inventors have recognized, among other things, that a problem to be solved can include replacing damaged components or upgrading existing components of ventilating exhaust fans without removing or replacing the entire fan assembly, which often requires extensive labor and often damages the surrounding building structure. In an example, the present subject matter can provide a solution to this problem, such as by a ventilation assembly having a main housing mountable within an aperture of a ceiling, wall or other building structure. The main housing can have an inlet opening corresponding to the size of the aperture in the ceiling, wall or building structure. A fan assembly having a releasable mount can be inserted through the inlet opening to mount the fan assembly within the main housing. The fan assembly can be mounted within the main housing prior to installation of the main housing and installed with the main housing or after installation of the main housing by inserting the fan assembly through the aperture and inlet opening.

This modular arrangement allows the fan assembly to be removed and repaired or replaced without removing the main housing, which is often the most arduous and difficult task as the surrounding structure must often be damaged to access the fasteners securing the main housing.

In an example, the ventilation assembly can also include an accessory component having an accessory mount for releasably interfacing with a positioning mount on a motor mount plate of the fan assembly. The engagement of the accessory mount and the positioning mount positions the accessory component against the motor mount plate of the fan assembly for receiving fasteners to fix the accessory component to the motor mount plate. The arrangement allows the accessory component to be mounted to the fan assembly after installation of the fan assembly in the main housing when the motor mount plate can be oriented in an orientation ordinarily difficult for installation of the accessory component. Similarly, the accessory mount can be disengaged from the positioning mount to remove the accessory component from the motor mount plate.

In an example, a method of mounting a ventilation assembly can include providing a main housing having a housing wall defining an interior space and an inlet opening. The method can also include providing a fan assembly including a fan and a motor mount plate. The method can also include positioning the main housing within an aperture of a building structure such that the inlet opening faces the aperture and inserting the fan assembly through the inlet opening such that the motor mount plate engages the housing wall.

In at least one example, the method can also include providing an accessory component having an accessory mount, the motor mount plate also including a positioning mount. The method can also include releasably engaging the accessory mount to the positioning mount to position the accessory component against the motor mount plate and inserting at least one fastener through the accessory mount to secure the accessory component to the motor mount plate. The accessory mount can include a hook element insertable into a receptacle defined by the positioning mount to releasably engage the accessory component to the motor mount plate.

In an example, a ventilation assembly can include a main housing having a housing wall defining an interior space and an inlet opening. The inlet opening corresponds to the cross-sectional area of the interior space defined by the housing wall. The ventilation assembly can also include a fan assembly including a fan and a motor mount plate having a releasable mount. The fan assembly is insertable through the inlet opening such that the motor plate engages the housing wall, the releasable mount being configured to receive at least one fastener to engage the fan assembly to the main housing.

In at least one example, the ventilation assembly can also include an accessory component having an accessory mount. The motor mount plate can also include a positioning mount engagable to the accessory mount to retain the accessory component proximate the motor mount plate. The accessory component can receive at least one fastener to mount the accessory component to the motor mount plate. The engagement of the accessory mount and the positioning mount maintain the position of the accessory component during insertion of the fastener. The accessory mount can include a hook element insertable into a corresponding receptacle of the motor mount plate to position the accessory component proximate the motor mount plate.

A ventilation assembly kit can include a main housing having a housing wall defining an interior space and an inlet opening. The inlet opening can correspond to the cross-sectional area of the interior space defined by the housing wall. The ventilation assembly can also include a fan assembly having a fan and a motor mount plate having a releasable mount and a positioning mount. The releasable mount can be configured to receive at least one fastener to mount the fan assembly to the main housing. The ventilation assembly can also include an accessory component having an accessory mount engagable to the positioning mount.

In an example, a method of mounting a ventilation assembly can include providing a main housing having a housing wall defining an interior space and an inlet opening and positioning the main housing within an aperture of a building structure such that the inlet opening faces the aperture. The method can also include providing a fan assembly including a fan and a motor mount plate and inserting the fan assembly through the inlet opening such that the motor mount plate engages the housing wall. The motor mount plate can also include a positioning mount. The method can also include providing an accessory component having an accessory mount and inserting the accessory component through the inlet opening. The method can also include releasably engaging the accessory mount to the positioning mount to position the accessory component against the motor mount plate.

In at least one example, the method can also include inserting at least one fastener through the accessory mount to secure the accessory component to the motor mount plate. The method can also include removing each fastener inserted through the accessory mount and disengaging the accessory component from the motor mount plate. The method can also include providing a second accessory component having a second accessory mount and releasably engaging the second accessory mount to the positioning mount to position the second accessory component against the motor mount plate.

In an example, a ventilation assembly can include a main housing having a housing wall defining an interior space and an inlet opening. The inlet opening can correspond to the cross-sectional area of the interior space defined by the housing wall. The ventilation assembly can also include a fan assembly including a fan and a motor mount plate having a releasable mount and a positioning mount. The fan assembly is insertable through the inlet opening such that the motor plate engages the housing wall. The releasable mount can be configured to receive at least one fastener to engage the fan assembly to the main housing. The ventilation assembly can include an accessory component having an accessory mount engagable to the positioning mount to retain the accessory component proximate the motor mount plate.

In at least one example, the accessory component is configured to receive at least one fastener to mount the accessory component to the motor mount plate. The engagement of the accessory mount and the positioning mount can maintain the position of the accessory component during insertion of the fastener. In at least one example, the ventilation assembly can also include a second accessory component having a second accessory mount. Each fastener is removable from the accessory mount to disengage the accessory component from the positioning mount such that the second accessory mount can be engaged to the motor mount plate.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 7A to 7B are perspective views of an accessory mount according to an example of the present disclosure.

FIG. 7C is a side-side view of an accessory mount according to an example of the present disclosure.

DETAILED DESCRIPTION

Figure 1:
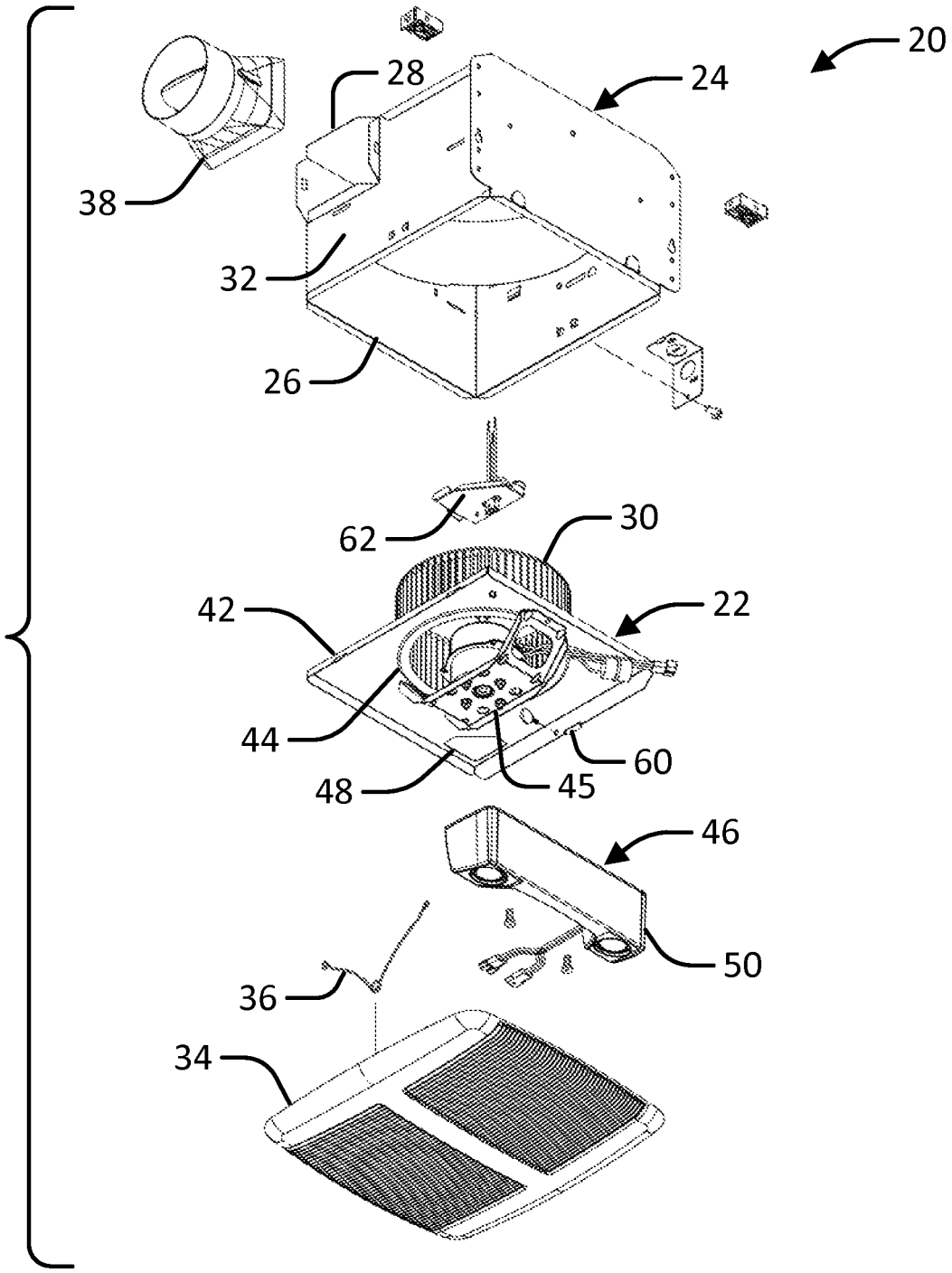
FIG. 1 is an exploded view of a ventilation assembly according to an example of the present disclosure.

As depicted in FIG. 1, a ventilation assembly 20, according to an example, can include a fan assembly 22 and a main housing 24. The main housing 24 can be mounted within an aperture in a wall or ceiling to a joist or other structure in the wall or ceiling. The main housing 24 can define an interior space and can include at least an inlet opening 26 aligned with the aperture in the wall or ceiling and an outlet opening 28. The fan assembly 22 can be positioned within the interior space defined by the main housing 24. The fan assembly 22 can include a fan 30 operable to create an inlet airflow through the aperture and inlet opening 26 into the interior space and an outlet airflow through the outlet opening 28 out of the interior space. The ventilation assembly 20 can be positioned within the wall or ceiling such that operating the fan 30 draws air through the aperture and inlet opening 26 from a first space and expelling the air through the outlet opening 28 to another space. In at least one example, the outlet opening 28 can be aligned with a second aperture or operably connected to ductwork to conduct the expelled air to a desired space.

In at least one example, the fan assembly 22 can be releasably mounted to the main housing 24 such that the fan assembly 22 can be removed from the main housing 24 through the inlet opening 26 without removing the main housing 24 from the wall, ceiling or other building structure. In certain situations, it can be desirable to replace a damaged fan assembly 22 or replace the existing fan assembly 22 with a fan assembly 22 having improved or different operating parameters to retrofit the ventilation assembly 20.

In at least one example, the fan assembly 22 can also be configured to releasably engage an accessory assembly 46 to provide added functionality to the ventilation assembly 20 including, but not limited to additional lighting, sound producing elements, air quality monitoring and other features. The accessory assembly 46 is releasably mounted to the fan assembly 22 such that the accessory assembly 46 can be disengaged from the fan assembly 22 while the fan assembly 22 is mounted within the main housing 24. The accessory assembly 46 can also be removed from the main housing 24 with the fan assembly 22 when the fan assembly 22 is disengaged from the main housing 24 and removed through the inlet opening 26 with the fan assembly 22. The accessory assembly 46 can be mounted as a new accessory component 50 or replace an existing accessory component 50. The fan assembly 22 can be installed within the main housing 24 with the accessory assembly 46 pre-mounted (i.e., at a factory during assembly of the ventilation assembly 20 or at an installation site just prior to or after installation of the main housing 24. The modular configuration of the ventilation assembly 20 permits installation or replacement of the fan assembly 22 or accessory assembly 46 through the aperture and inlet opening 26 and without removal and reinstallation of the main housing 24, which can cause damage to the wall or ceiling and associated support structure.

The replacement fan assembly 22 and/or accessory can be an upgrade (i.e., as a retrofit) to the ventilation assembly 22 that would normally not include an accessory. Similarly, the fan assembly 22 or accessories can be removed and replaced without disconnecting the main housing 24 from attached ductwork.

As depicted in FIG. 1, in an example, the main housing 24 includes the housing wall 32 defining the interior space within the main housing 24. The housing wall 32 can further define the inlet opening 26 and the outlet opening 28. The main housing 24 can be configured to house and mount structure for at least a portion of the various components and devices of the ventilation assembly 20. The main housing 24 can comprise a plurality of shapes corresponding to the size and shape of the components and devices to be housed and the available space within the wall or ceiling. The main housing 24 can have shapes including, but not limited to, a rectangular box-like shape, an oval shape, a hemispherical shape, a spherical shape, a pyramidal shape, or any other shape. The main housing 24 can include materials suitable for supporting the weight of the fan assembly 22 and accessories and receiving fasteners for securing the main housing 24 to a wall or ceiling joint or other structure. The main housing 24 can comprise, but is not limited to, an aluminum-based metal, a steal or iron-based metal, a zinc-based metal, or a nickel and tin-based metal, injected molded polymers, thermo-formed polymers, thermosetting polymers, wood, particle-board, wood laminate, composite materials or combination of materials.

Figure 2:
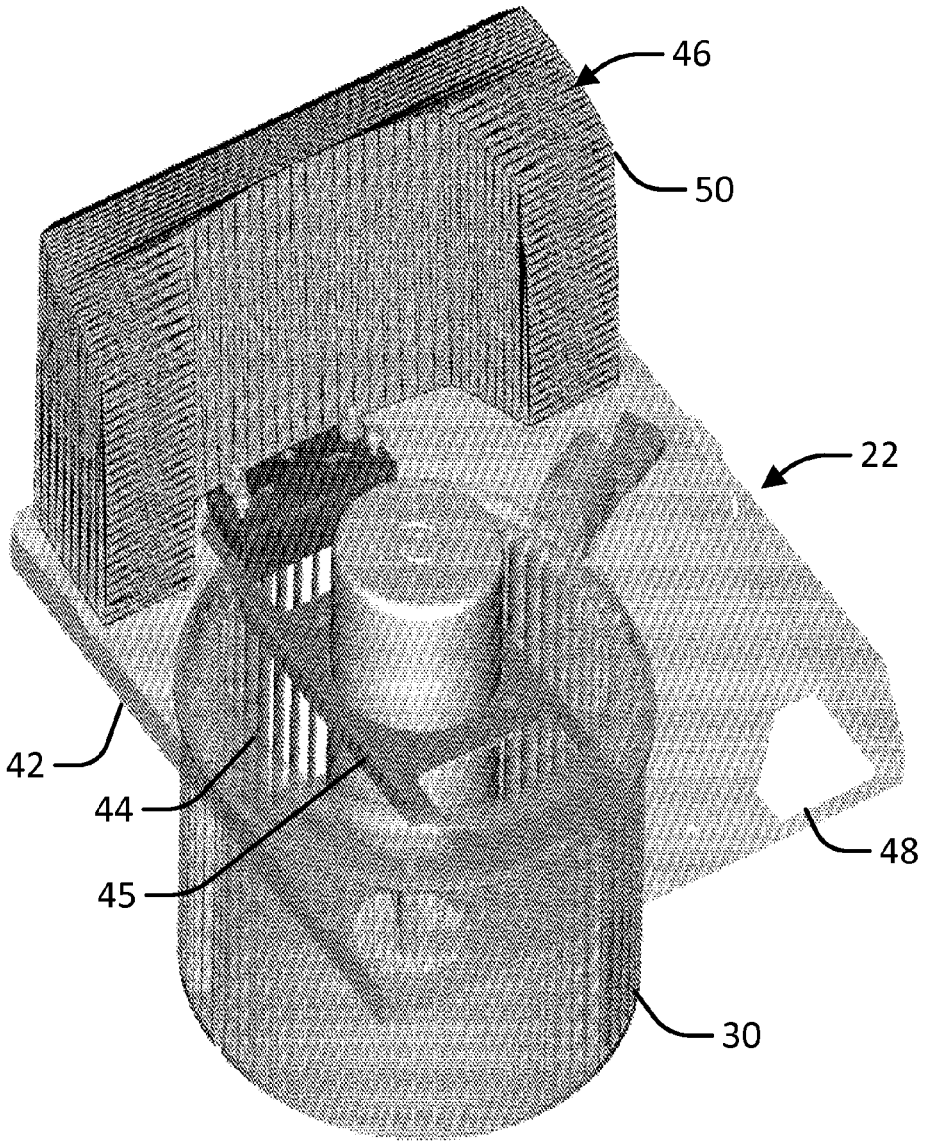
FIG. 2 is a perspective view of a fan speaker assembly according to an example of the present disclosure.
Figure 3A:
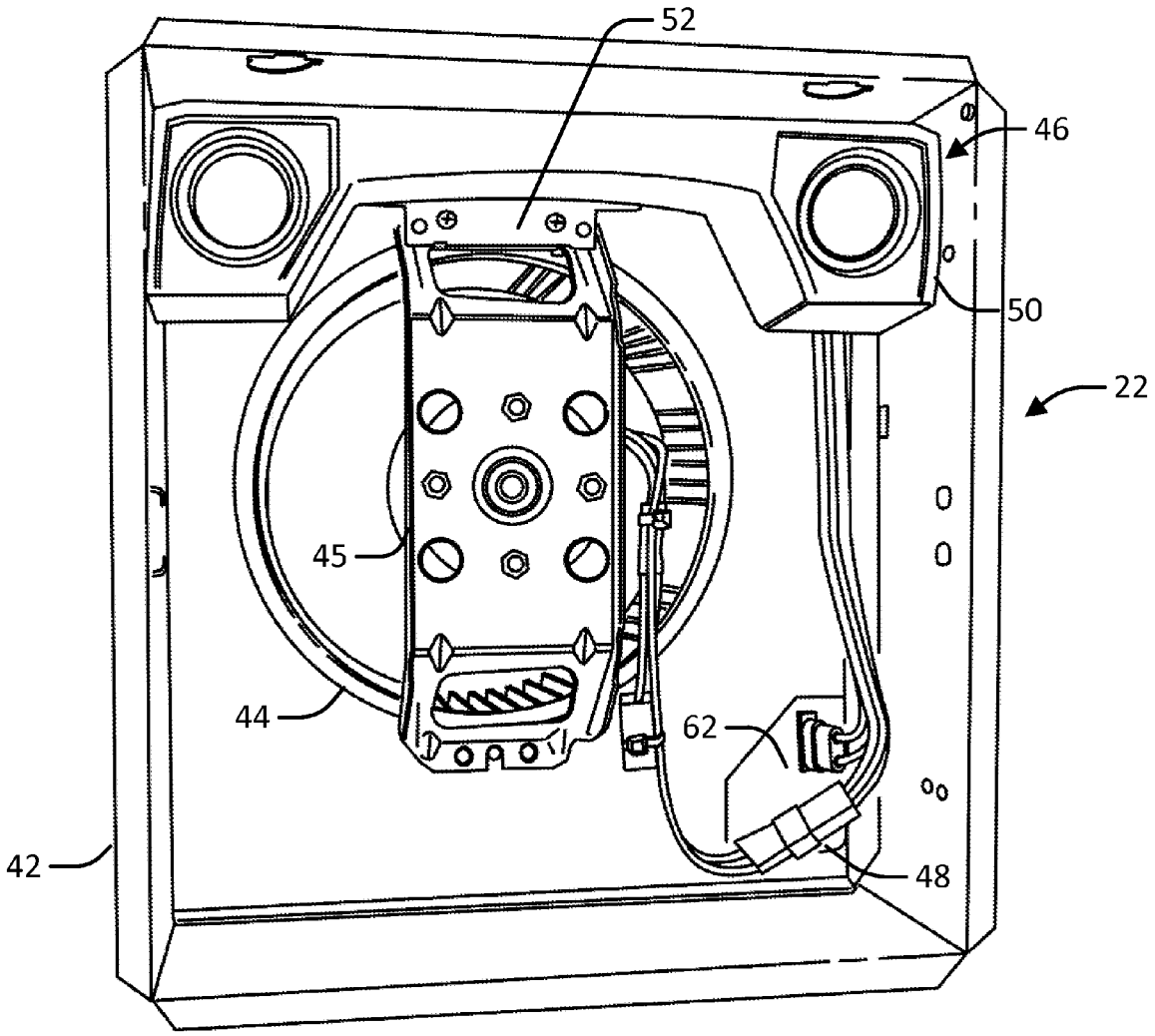
FIG. 3A is a top perspective view of a fan speaker assembly with attached accessory assembly according to an example of the present disclosure.
Figure 3B:
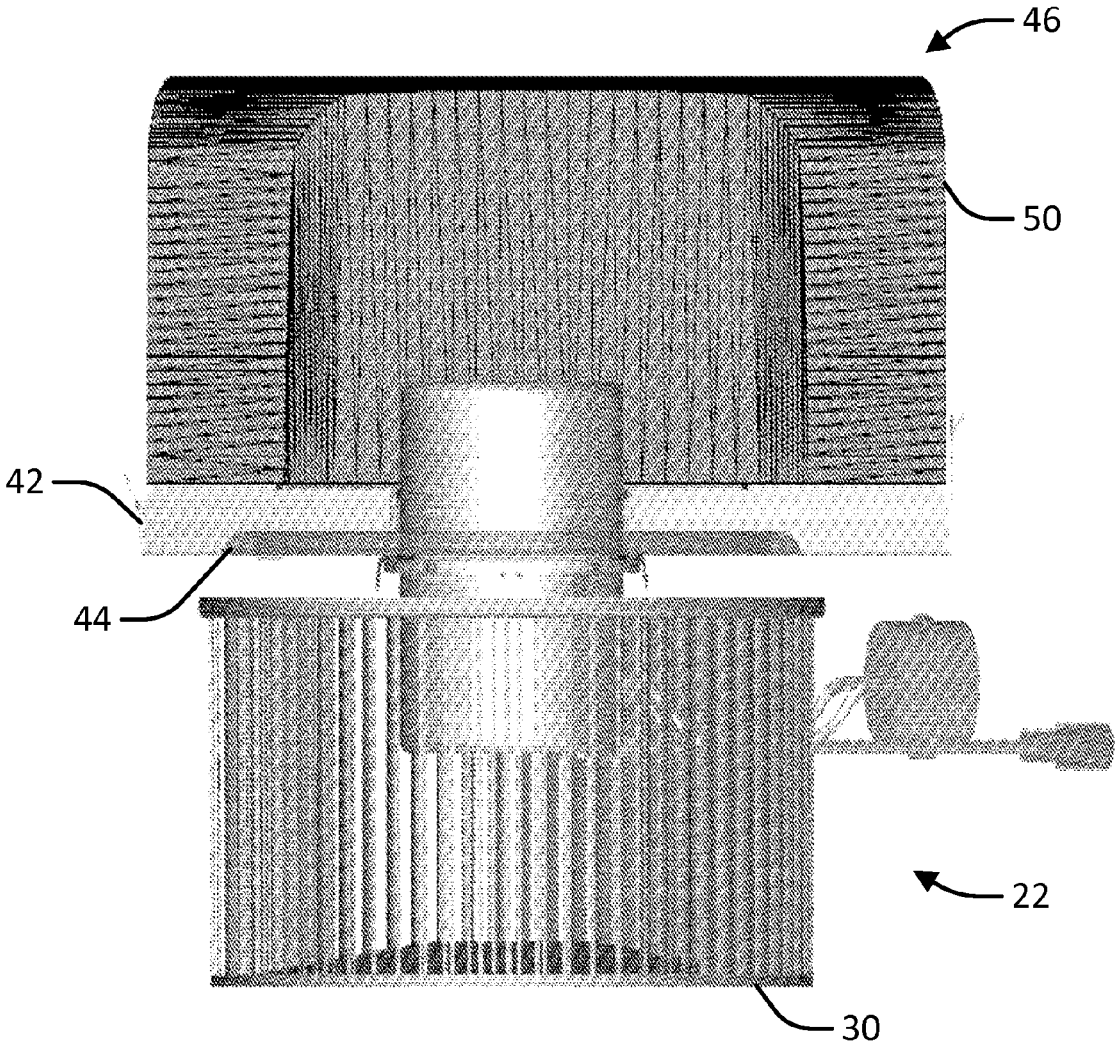
FIG. 3B is a front view of a fan speaker assembly with attached accessory assembly according to an example of the present disclosure.
Figure 4:
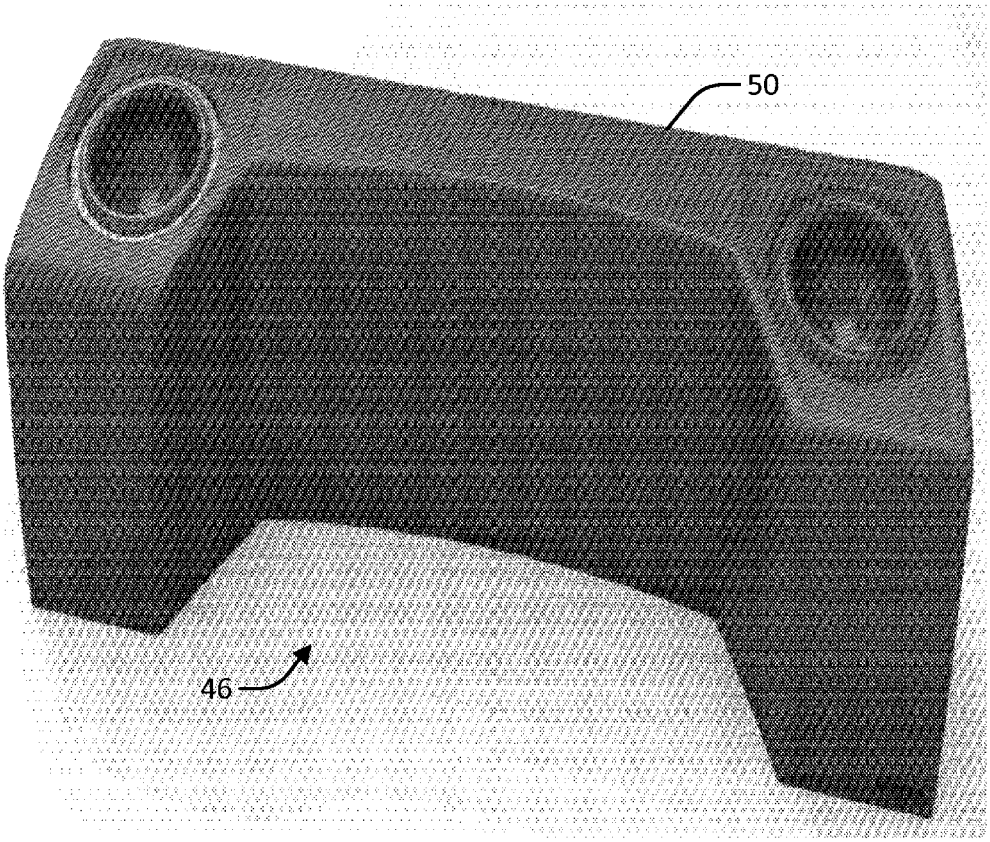
FIG. 4 is a perspective view of an accessory component according to an example of the present disclosure.
Figure 5A:
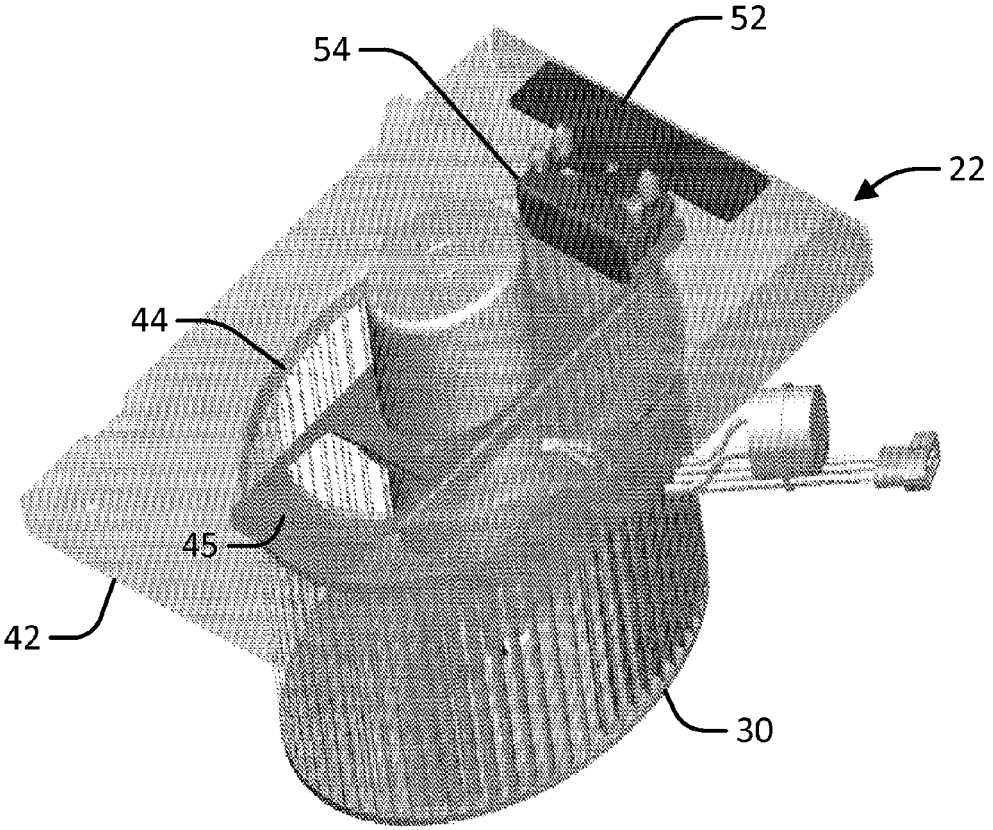
FIG. 5A are perspective views of an exhaust fan assembly including an accessory mount according to an example of the present disclosure.
Figure 5B:
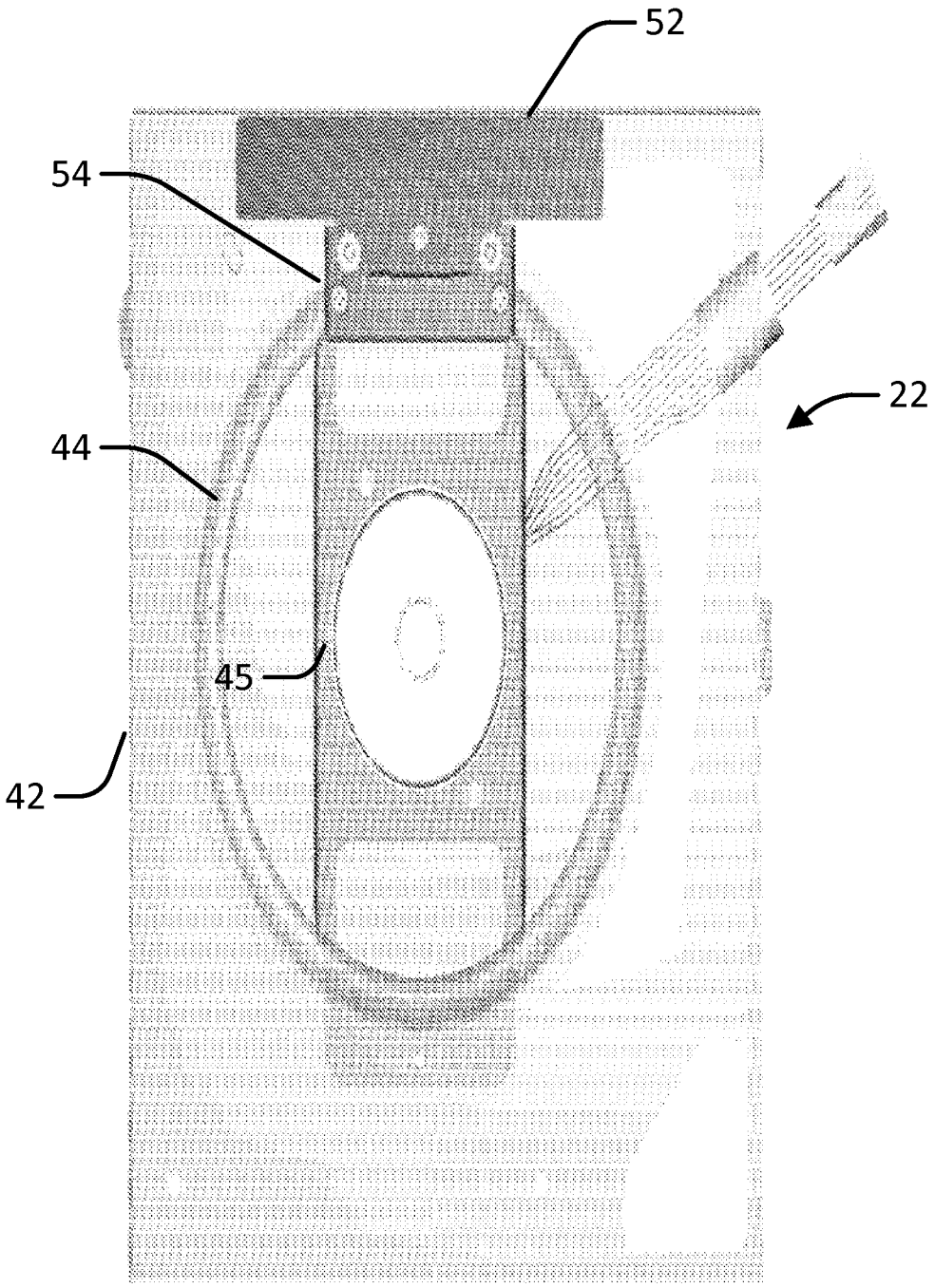
FIG. 5B is a top view of an exhaust fan assembly including an accessory mount according to an example of the present disclosure.

As depicted in FIGS. 2 and 3A-3B, in an example, the fan assembly 22 can include a fan 30, a fan mount 45 and a motor mount plate 42. The motor mount plate 42 can include a fan opening 44. The fan mount 45 can receive at least one fastener to mount the fan 30 to the motor mount plate 42 such that position the fan 30 within the fan opening 44. In at least one example, the fan 30 can comprise a centrifugal fan having a motor for rotating a blower wheel to draw air through the fan opening 44. In at least one example, the fan mount 45 can be substantially linear as depicted in FIG. 2. In at least one example, the fan mount 45 can be substantially arched as depicted in FIGS. 3A-3B. The blower wheel can be mechanically coupled to the motor using a main drive bolt. The fan 30 can comprise other conventional fans for drawing air and other gases through the fan opening 44. In at least one example, the motor mount plate 42 can include an electrical port 48 through which wires can be threaded past the motor mount plate 42.

As depicted in FIGS. 4, 5A-5B and 6A-6B, an accessory assembly 46 can include an accessory component 50 and an accessory mount 52. In at least one example, the accessory component 50 can include an acoustic device having a housing and at least one sound emitting device. The sound emitting device can include at least one loudspeaker (i.e., the housing and each sound emitting device is formed or coupled as a single unit and functional integral as a monolithic structure to emit sound). The acoustic device can be formed into any shape, but generally is shaped to provide a desirable acoustic response without blocking fan opening 44. In at least one example, each loudspeaker can include a flexible, but semi-rigid membrane attached to an electromagnetic coil. A current can be passed through the coil can cause the semi-rigid membrane to at least partially move in the magnetic gap, thereby vibrating the diaphragm, and producing sound waves.

Figure 6A:
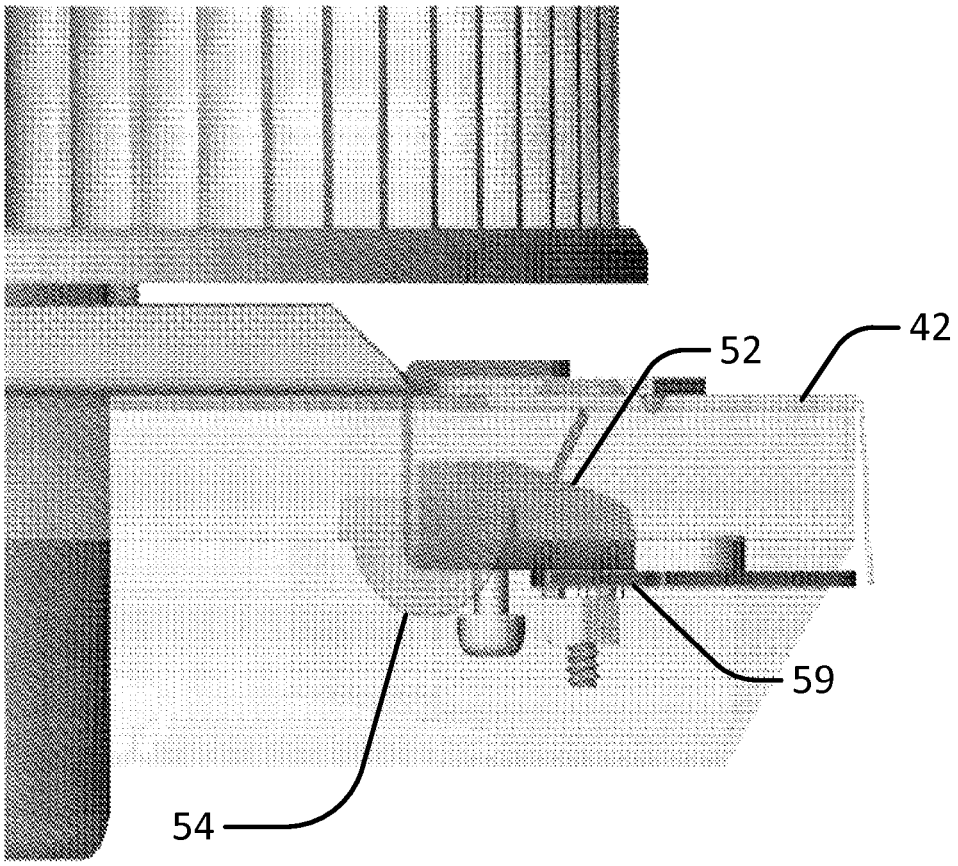
FIG. 6A is a side view of an exhaust fan assembly including an accessory mount for an accessory assembly according to an example of the present disclosure.
Figure 6B:
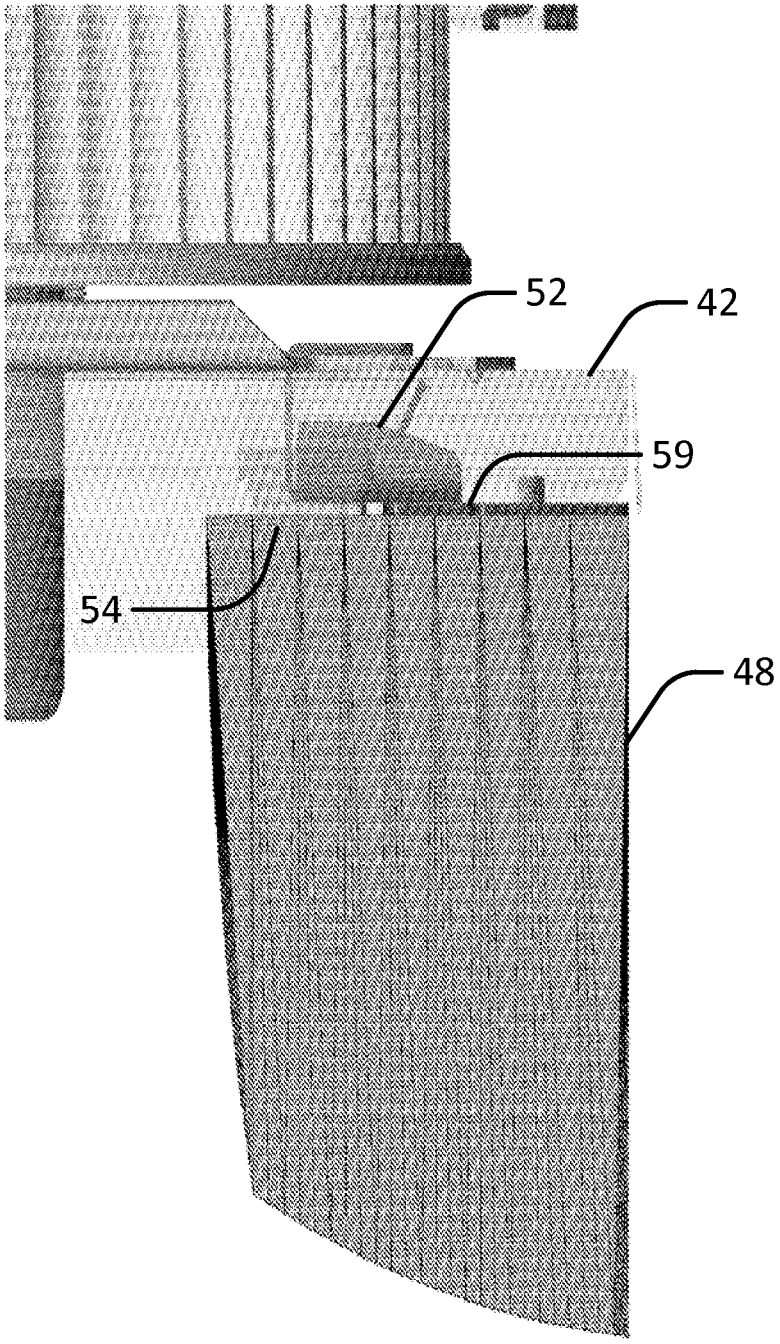
FIG. 6B is a side view of an exhaust fan assembly including an accessory mount coupled to an accessory component according to an example of the present disclosure.
Figure 7A:
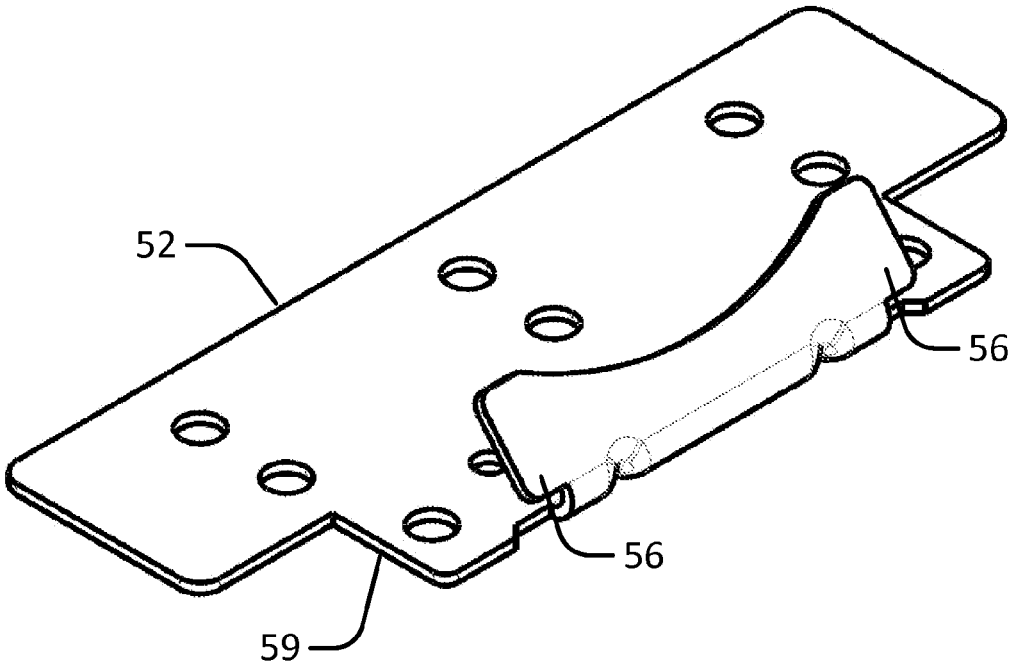
Figure 8A:
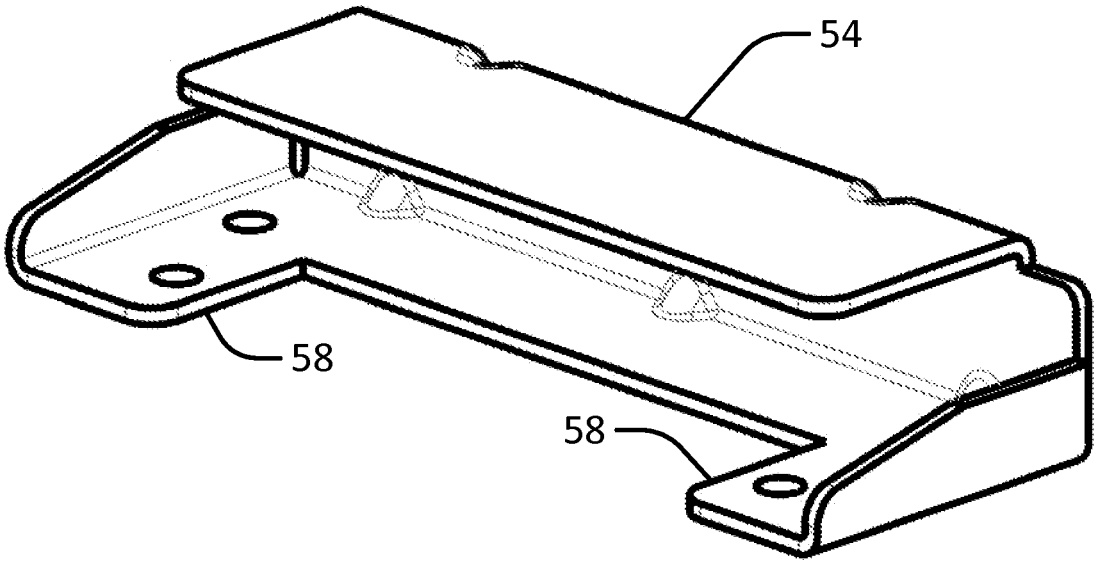
FIG. 8A is a perspective view of a positioning mount according to an example of the present disclosure.
Figure 8B:
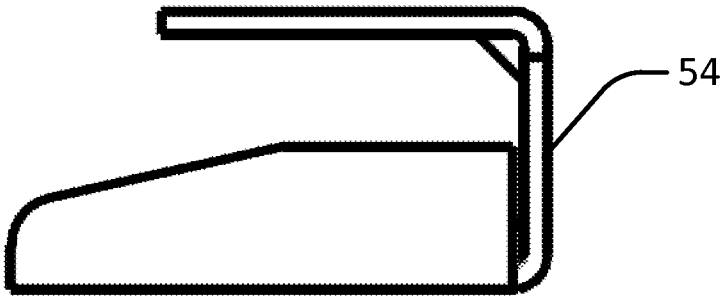
FIG. 8B is a side view of a positioning mount according to an example of the present disclosure.
Figure 8C:
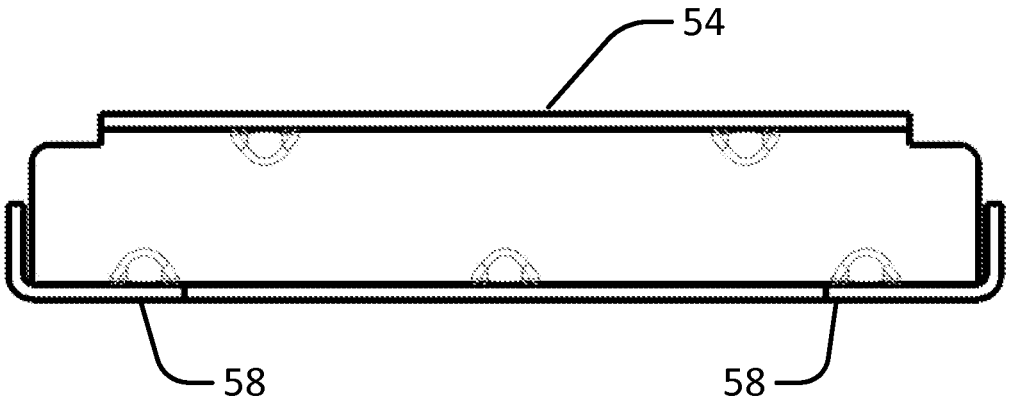
FIG. 8C is a front view of a positioning mount according to an example of the present disclosure.
Figure 9A:
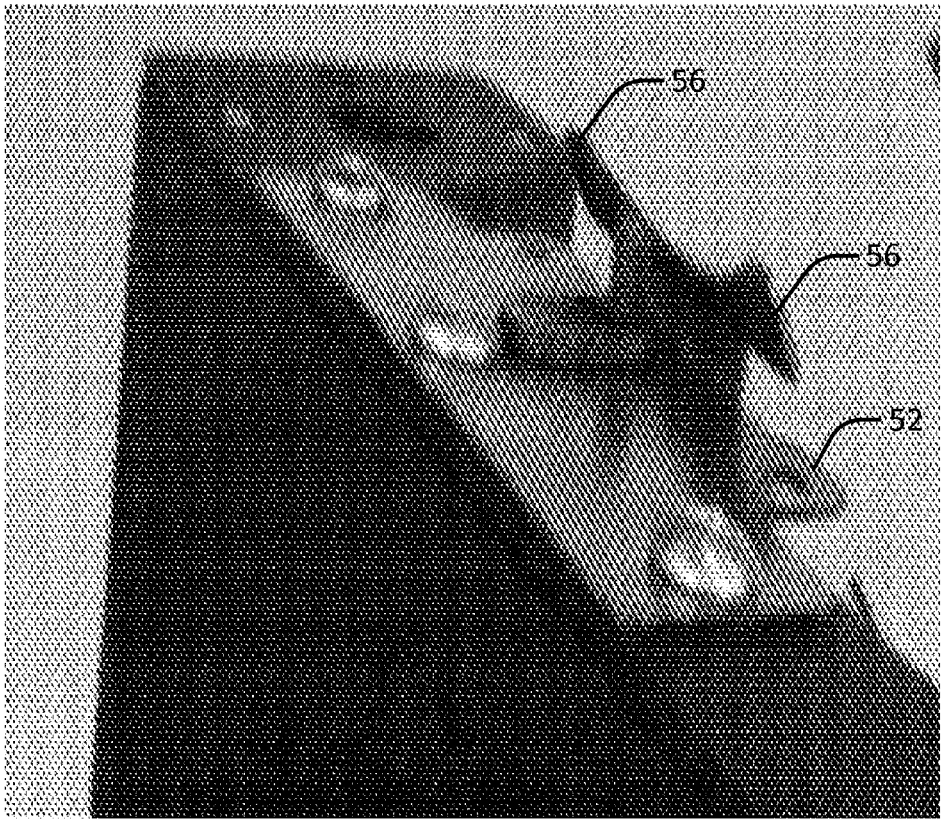
FIGS. 9A to 9B are perspective views of the accessory mount depicted in FIGS. 7A to 7C coupled to the bottom edge of the accessory component depicted in FIG. 4 according to an example of the present disclosure.
Figure 9B:
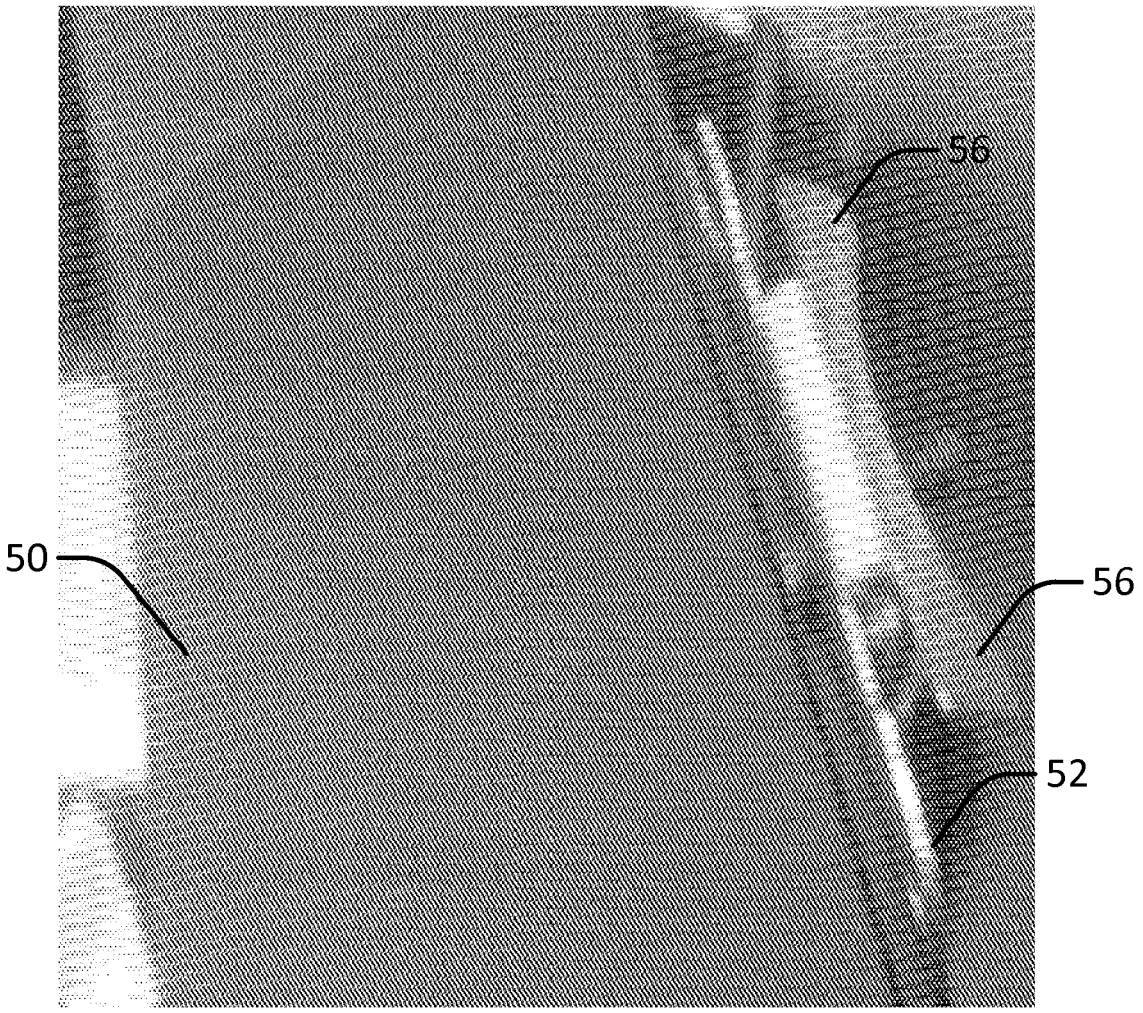
Figure 9C:
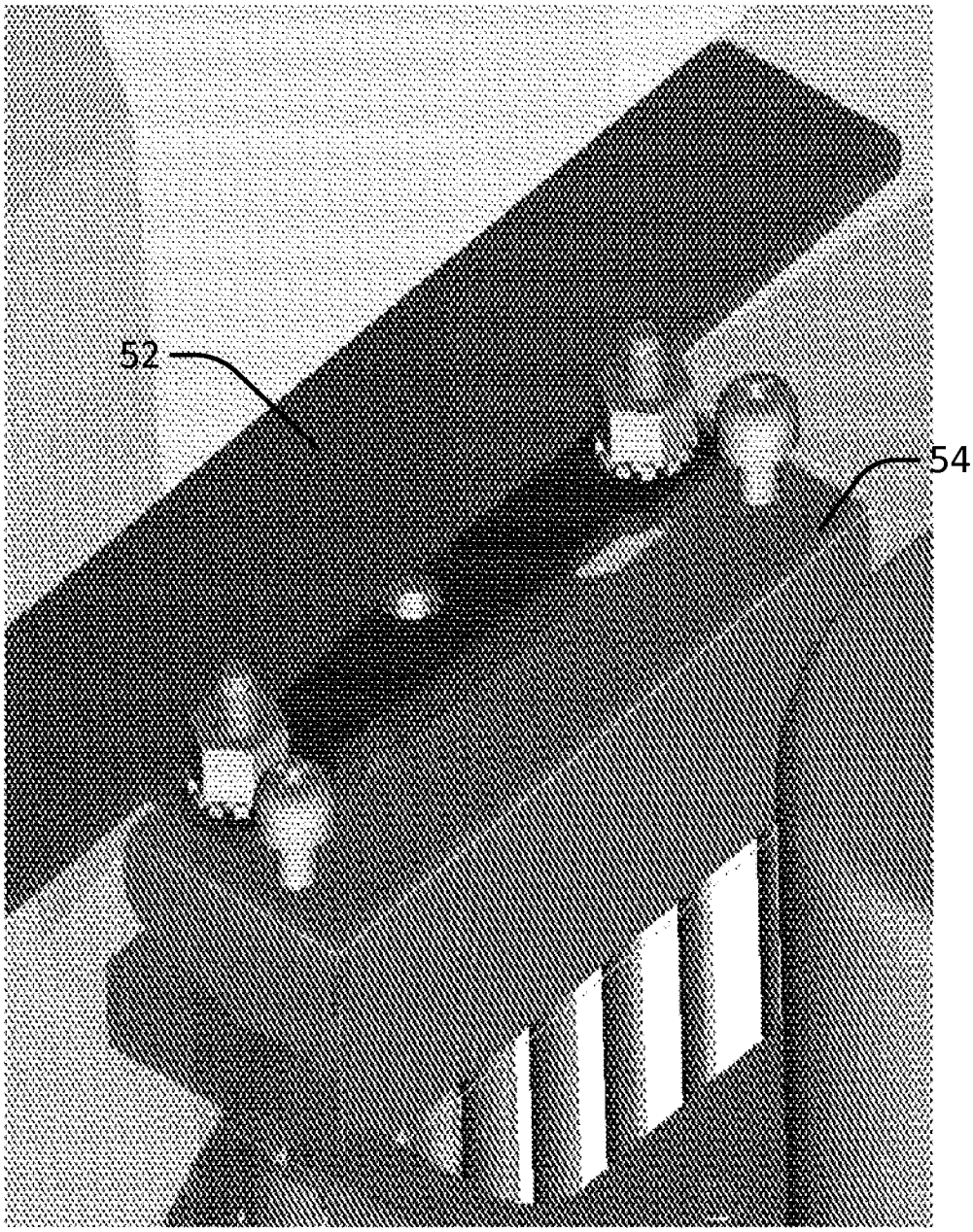
FIG. 9C is a partial perspective view of the accessory mount depicted in FIGS. 7A to 7C coupled to the fan assembly of the ventilation assembly shown in FIGS. 3A to 3B according to an example of the present disclosure.
Figure 9D:
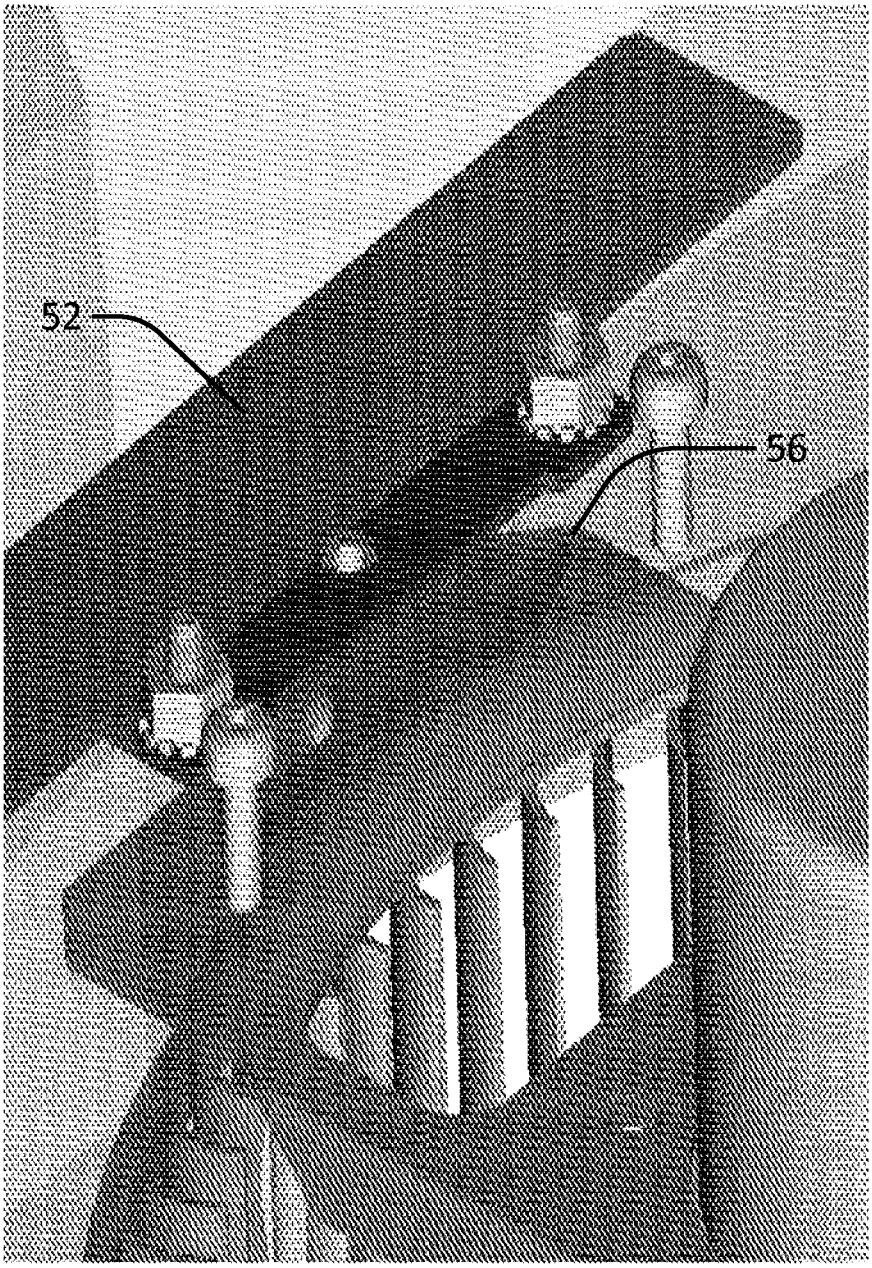
FIG. 9D is a partial perspective view of the accessory mount depicted in FIGS. 7A to 7C coupled to the exhaust fan assembly of the ventilation assembly shown in FIGS. 2 and 3A to 3B without the speaker assembly according to an example of the present disclosure.
Figure 12A:
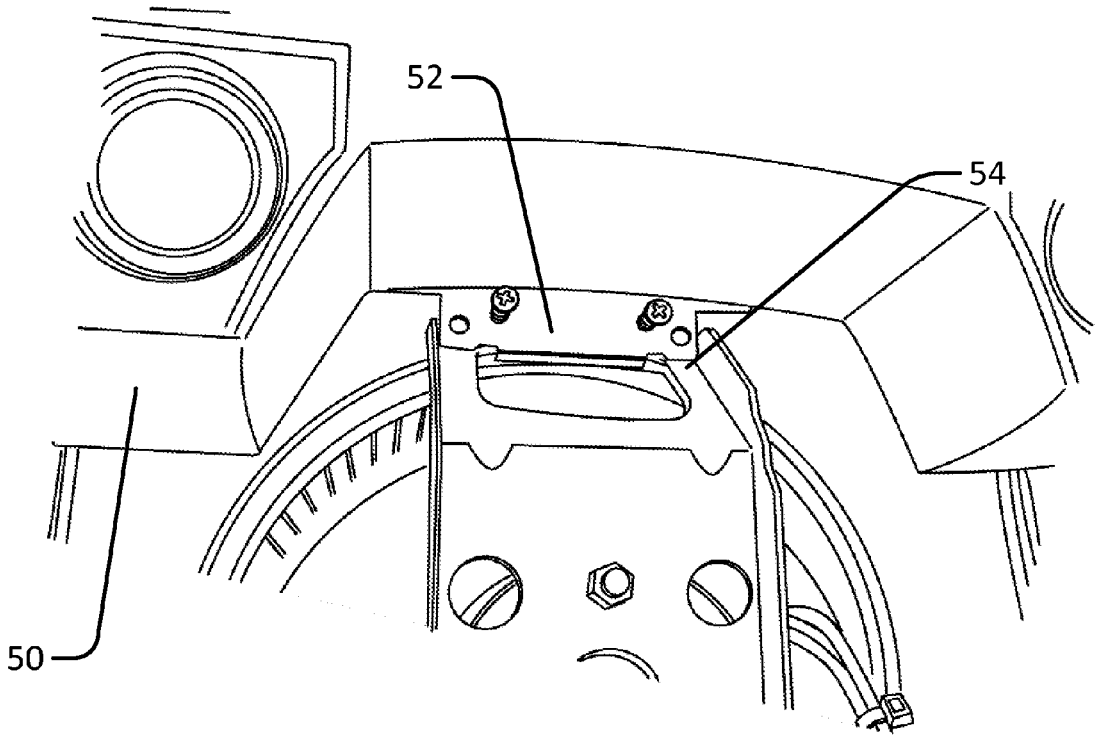
FIG. 12A is a front partial perspective view of an accessory assembly coupled to a fan assembly according to an example of the present disclosure.

As depicted in FIGS. 7A-7C and 8A-8C, in an example, the fan assembly 22 can also include a positioning mount 54 corresponding to the accessory mount 52 to releasably secure the accessory component 50 to the fan assembly 22. In an example, the accessory mount 52 can include at least one hook element 56 and a tab portion 59. The positioning mount 54 can include a receptacle 58 corresponding to each hook element 56. The hook element 56 can be inserted into the receptacle 58 to position the accessory component 50 on the motor mount plate 42 as illustrated in FIG. 6A. In at least one example, the receptacle 58 can be angled away from the body of the motor mount plate 42 to complement the sloping angle of the motor mount plate 42 as illustrated in FIG. 7A. In an example, the hook element 56 is oriented such that the tab portion 59 is generally parallel to the motor mount plate 42. A fastener can than be subsequently inserted through the tab portion 59 to fix the accessory component 50 to the fan assembly 22 as illustrated in FIG. 12A. In at least one example, the accessory mount 52 can be mounted to the positioning mount 54 prior to attachment of the accessory component 50 as illustrated in FIGS. 6A-6B. In at least one example, the accessory component 50 can be mounted to the accessory mount 52 prior to attachment of the accessory mount 52 to the positioning mount 54 as illustrated in FIGS. 9A-9B. In at least one example, the accessory component 50 is angled to insert the hook element 56 into the receptacle 58 and rotated to secure the accessory component 50 to the motor mount plate 42 as illustrated in FIG. 7C. In at least one example, the accessory component 50 can be positioned on the motor mount plate 42 such that the accessory component 50 is positioned away from moving components such as the fan 30.

In at least one example, the accessory component 50 can be shaped to form a compact and desirable acoustic flow towards the inlet opening 26 when mounted to the motor mount plate 42. The accessory component 50 can be coupled to the motor mount plate 42 such that the accessory component 50 and the motor mount plate 42 are resonantly coupled. The sound emitting device can be formed from any material that is readily shaped, including, but not limited to polymers, polymer-composites, metals, paper composites or fiber-based composites. In at least one example, injection-molded or thermo-formed polymeric materials can be molded to form functional components into the housing of the sound emitting device. The sound emitting device can include a resin treated cloth, fabric or non-woven material. In at least one example, the sound emitting device can include polymeric foams or thermoplastic elastomers over-molded onto the body of the diaphragm. The diaphragm can be integrally formed into the surrounding sound emitting device.

Figure 12B:
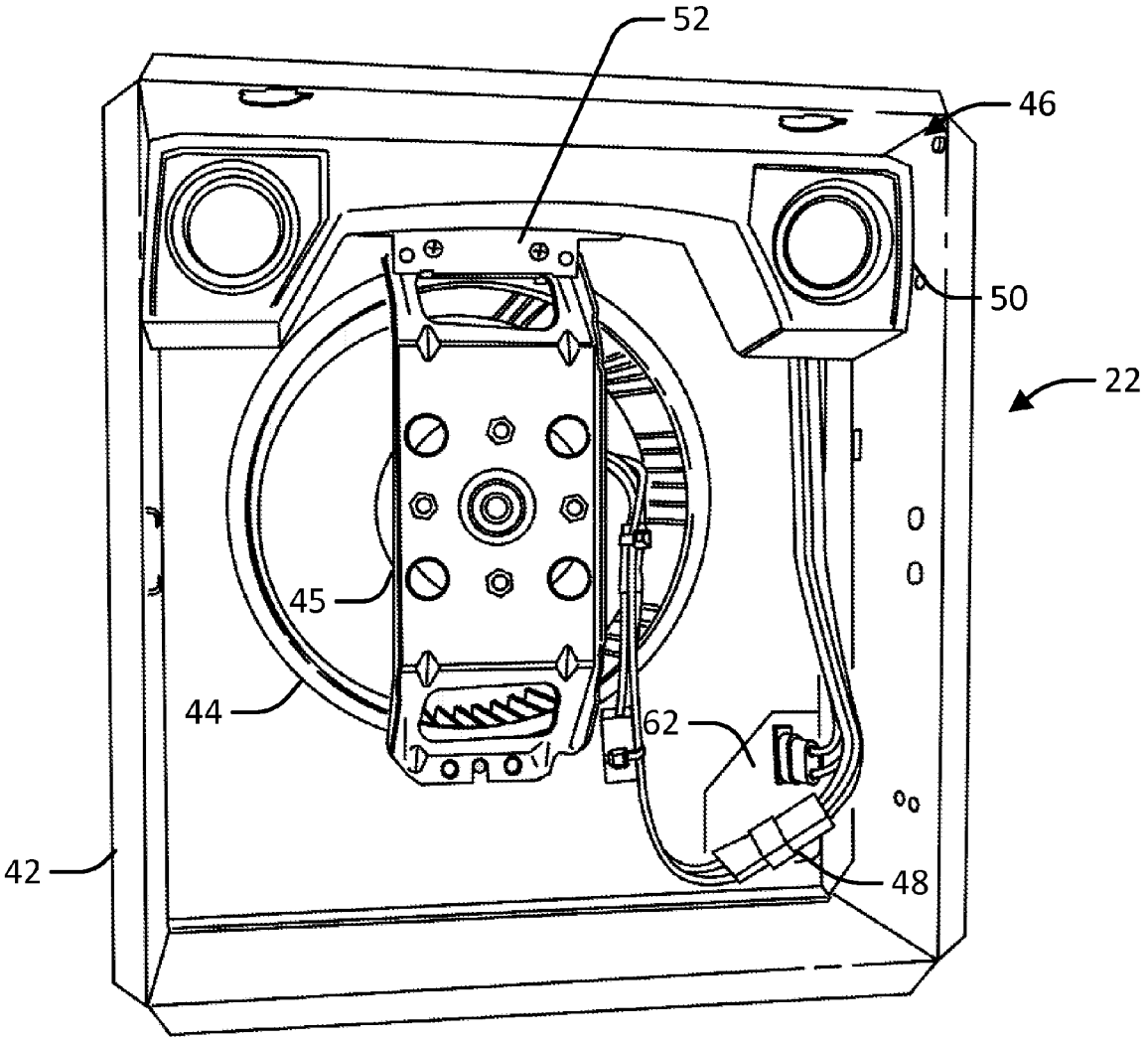
FIG. 12B is a top perspective view of a ventilation assembly according to an example of the present disclosure.

As depicted in FIGS. 1 and 12B, the ventilation assembly 20 can include an electrical box having a power receptacle. The power receptacle can be connected to an external power source such as the power supply for the building or structure. The power receptacle can include at least one terminal to which the fan 30 or accessory component 50 can be connected to supply power to the fan 30 or accessory component 50. The accessory component 50 can be mounted on the motor mounting plate 42 opposite from the power receptacle. The arrangement increases the electromagnetic and acoustic isolation between the accessory component 50 and the power receptacle. In at least one example, the motor mount plate 42 can include an electrical port 62 for interfacing with the power receptacle. The edges of the electrical port 62 can engage the power receptacle to prevent the flow of fluid through the electrical port 62. In at least one example, each terminal can be oriented to be accessible through the electrical port 62 while the power receptacle prevents air flow through the electrical port 62. In at least one example, a permanent split capacitor can be mounted to a surface of a structure of the building adjacent to the ventilation assembly 20 and electrically coupled to the speaker fan assembly with a motor power harness.

In an example, the accessory component 50 can include an electrical circuit that is electrically coupled to the sound emitting device. In some embodiments, the electrical circuit includes at least one switch capable of switching power to or off the speaker assembly. In some embodiments, the sound emitting device can be powered when a user powers the fan 30 (i.e., when the user switches power to the fan assembly 22 for ventilation, the accessory component 50 can also be powered). In some other embodiments, the accessory component 50 can include a power supply that is independent of the electrical box coupled to the main housing 24.

In an example, the accessory component 50 can include a wireless receiver. The accessory component 50 can include a wireless receiver or transceiver, including, but not limited to a Bluetooth® transceiver or a WiFi receiver or transceiver. In at least one example, the accessory component 50 can include a wireless receiver or transceiver capable of responding to a two-way radio RF signal, a UHF or VHF signal (such as a citizen's band radio signal or other radio signal emitted from a 'walkie talkie' type device), and a near-field wireless signal. Bluetooth® is a registered trademark of Bluetooth SIG, Inc. In at least one example, the accessory component 50 can include a wireless receiver capable of responding to a zero generation wireless signal, a first generation wireless signal, a second generation wireless signal, a third generation wireless signal, a fourth generation wireless signal, or a fifth generation wireless signal.

In an example, the wireless receiver can be powered when a user powers the fan 30 (i.e., when the user switches power to the fan assembly 22 for ventilation, the sound emitting device and the wireless receiver can also be powered). In at least one example, an acoustic member (such as at least one diaphragm) of the sound emitting device can emit sound based at least on a wireless signal received by the accessory component 50. In at least one example, sound (such as music or speech) can be encoded by a user's wireless device that emits a wireless signal that is capable of being received and decoded by the wireless receiver within the fan speaker assembly and at least partially reproduced by the sound emitting device of the accessory component 50. In some embodiments, a user may program a wireless device to transmit a wireless signal to the accessory component 50. In some embodiments, the accessory component 50 can be a wireless receiver that accepts any signal sent by a user from a wireless device.

In at least one example, the accessory component 50 may be wirelessly controlled. For example, in an example, the accessory component 50 be encoded by a user's wireless device that emits a wireless signal that is capable of being received and decoded by the wireless receiver within the fan speaker assembly to control at least partially control at least one function of the speaker assembly and/or the fan speaker assembly.

In an example, the main housing 24 is configured to be positioned within an aperture in a wall, ceiling or other building structure in a partially, or fully recessed position. In at least one example, the inlet opening 26 can be sized to correspond to the size and shape of the aperture in the wall, ceiling or other building structure. The main housing 24 can include a grille 34 having a fastener 36 for securing the grille 34 to the housing wall 32 over the inlet opening 26 to conceal the inlet opening 26 and restrict access to the interior space. The fastener 36 can be configured to be released and disengage the grille 34 from the main housing 24 to permit access to the interior space through the inlet opening 26. The main housing wall 32 can be configured to receive at least one fastener to secure the main housing 24 to joists or other building support structure.

As depicted in FIG. 1, in an example, the housing wall 32 can include a duct connector assembly 38 at the outlet opening 28 for operably connecting the outlet opening 28 to a ventilation duct of a building. In certain examples, the duct connector assembly 38 can be pre-installed in a building structure in with the existing ductwork and the attached to the housing wall 32 when the housing wall 32 is mounted within the wall or ceiling. In certain examples, the main housing 24 is firstly installed in an existing cavity or aperture of a structure and the duct connector assembly is subsequently installed by connecting a ventilation duct of the ductwork with the outlet opening 28 of the main housing 24.

Figure 10:
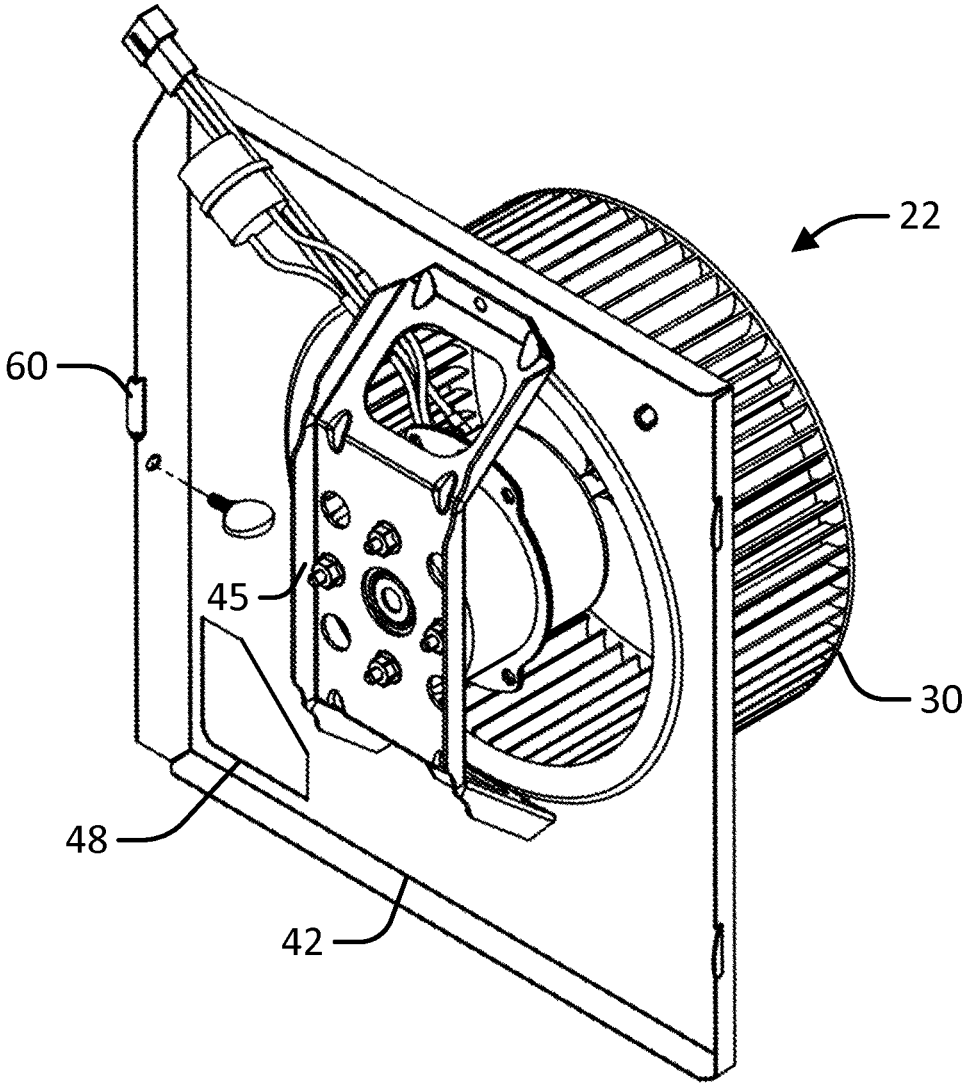
FIG. 10 is a perspective view of a fan assembly according to an example of the present disclosure.
Figure 11A:
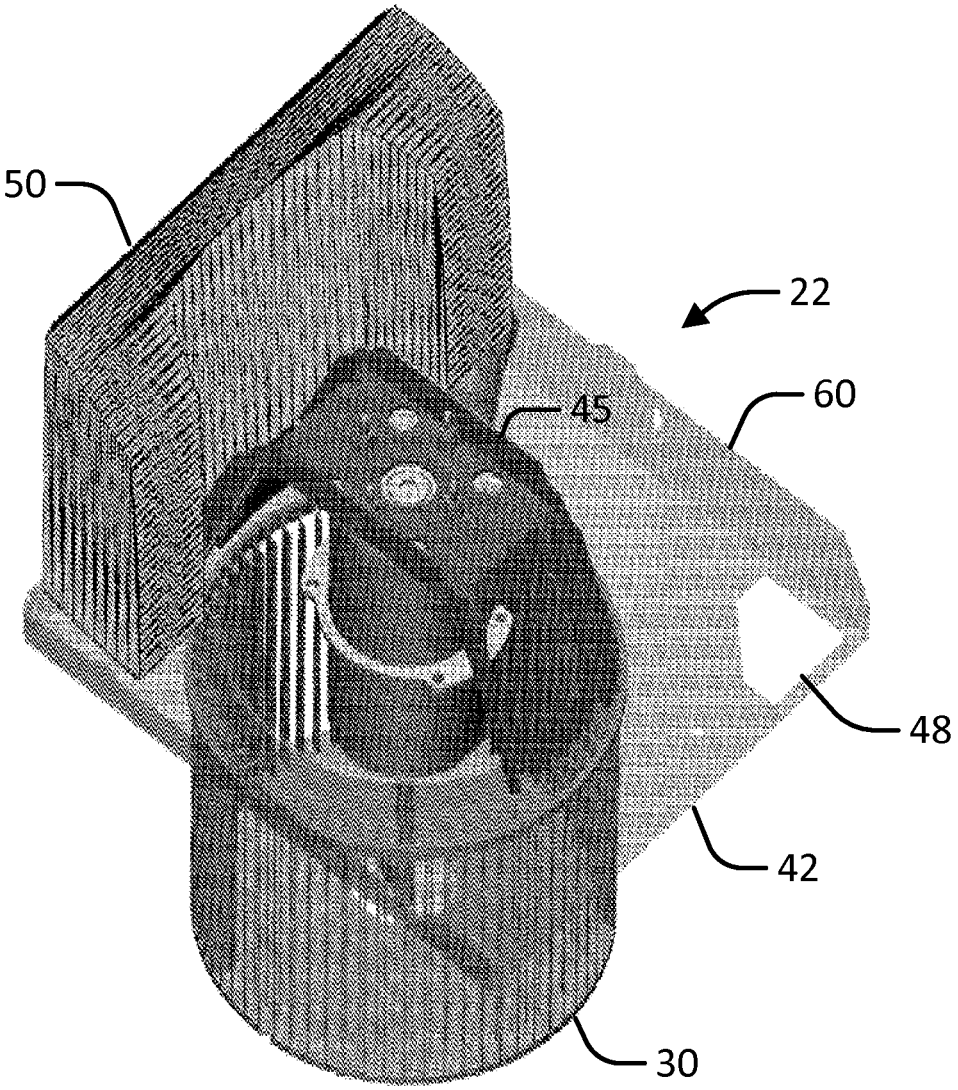
FIGS. 11A to 11B are perspective views of a fan assembly coupled to an accessory assembly according to an example of the present disclosure.
Figure 11B:
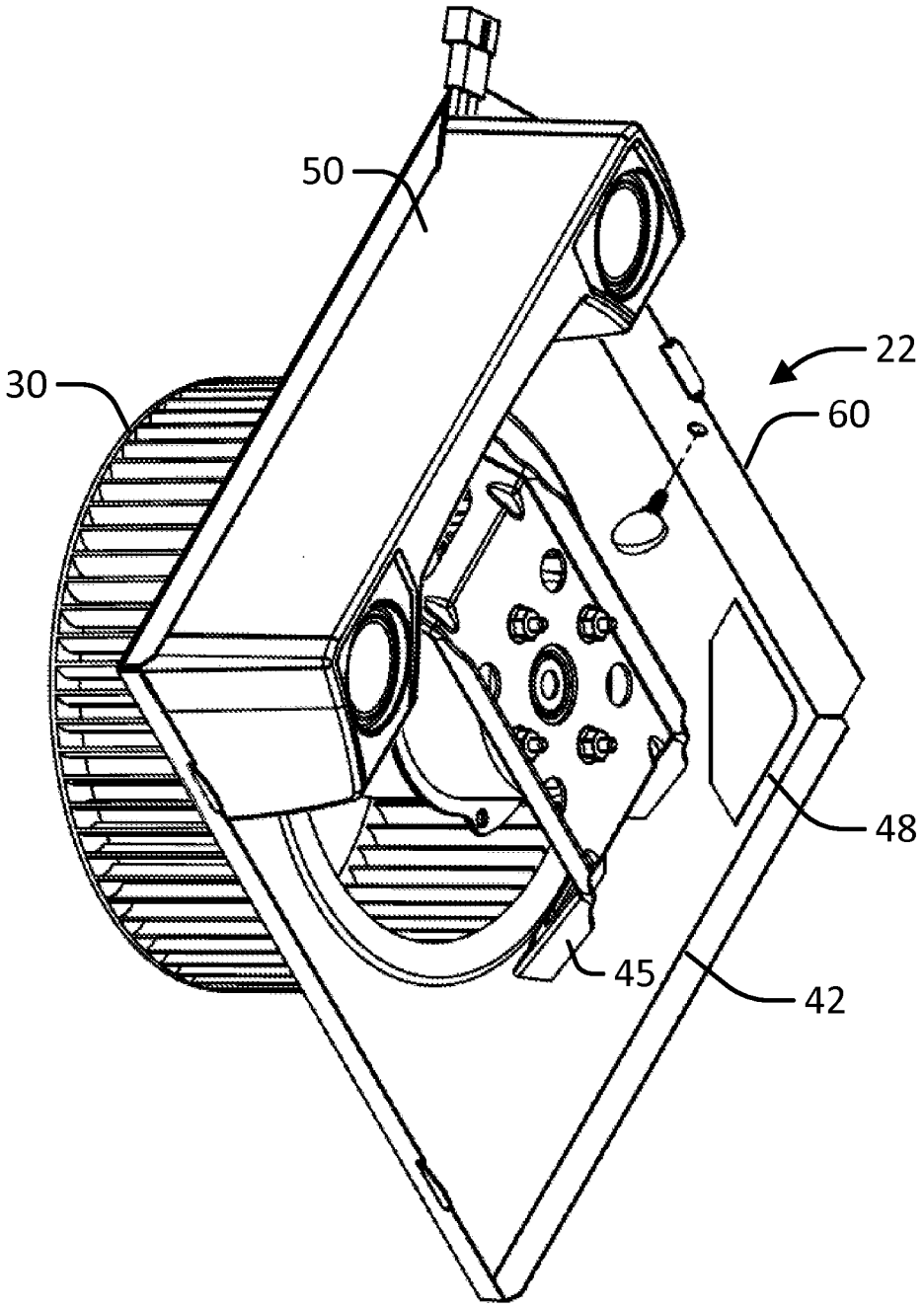

As depicted in FIG. 12B, in an example, the fan assembly 22 can be positioned within the interior space of the main housing 24. The motor mount plate 42 can be engaged to the housing wall 32. In at least one example, the motor mount plate 42 can further include a releasable mount 60 for releasably engaging the motor mount plate 42 to the housing wall 32. The releasable mount 60 can be configured to receive a removable fastener that can be inserted to engage the fan assembly 22 to the main housing 24 or removed to release the fan assembly 22 from the main housing 24. In at least one example, the releasable mount 60 can include a flexible tab that can be releasably engaged into a corresponding receptacle in the housing wall 32. In at least one example, the tab can be used to initially position the fan assembly 22 within the main housing 24 until the fastener can be inserted through the releasable mount 60 as depicted in FIG. 10. The fan assembly 22 can be removed from the main housing 24 by removing the fastener and replaced or swapped with another fan assembly 22. In at least one example, the main housing 24 can be mounted within the ceiling, wall or other building structure with the fan assembly 22 pre-installed. In at least one example, the main housing 24 can be mounted within the ceiling, wall or other building structure and the fan assembly 22 can than subsequently be installed by inserting the fan assembly 22 through the aperture and the inlet opening 26. In at least this example, the inlet opening 26 can be sized to correspond to the dimensions of the housing wall 32 to receive the fan assembly 22 through the inlet opening 26.

As depicted in FIGS. 6A-6B and 11A-11B, in an example, the accessory component 50 can be mounted to the motor mount plate 42 by initially engaging the accessory mount 52 to the positioning mount 54 and subsequently inserting a fastener through the tabbed portion 58. In at least one example, the accessory component 50 can be mounted to the fan assembly 22 prior to installation of the fan assembly within the main housing 24. In at least one example, the fan assembly 22 can be pre-installed within the main housing 24 or installed after the main housing 24 is mounted within the aperture of the ceiling or wall. In at least this example, the accessory component 50 can be inserted through the aperture and inlet opening 26. The accessory component 50 can then be engaged to the motor mount plate 42 in situ via the component mount 52 and positioning mount 54. The engagement of the hook element 56 to the receptacle 58 retains the accessory component 50 in place on the motor mount plate 42 until the fastener is inserted through the tab portion 59 to fix the accessory component 50. In at least one example, a mounted accessory component 50 can be replaced or swapped with a different accessory component. The fastener can be removed from the tab portion 59 and the accessory component 50 pivoted to disengage the hook element 56 from the receptacle 58 such that the accessory component 50 can be un-mounted from the fan assembly 22.

In an example, the motor mount plate 42 can be positioned to operate as a partition separating the inlet opening 26 and outlet opening 28, wherein the fan opening 44 defines a fluid path between the inlet opening 26 and the outlet opening 28. In operation, the fan 30 is operable to draw a fluid, such as air and other gases, through the inlet opening 26 and the fan opening 44 and expelling the fluid out the outlet opening 28. The fluid can comprise, but is not limited to, air, other gases, vapor or combinations thereof. In at least one example, the fluid can comprise a smoke, ash, or other particulate in addition to air or other gases. In at least one example, the main housing 24 can include at least one damper flap positioned at the outlet opening 28. The damper flap can control the backflow of a fluid into the interior space through the outlet opening 28.

In at least one example, the main housing 24 can include a scroll element for directing air from the blower wheel into the outlet opening 28. The scroll element can comprise a readily shaped material including, but not limited to polymers, polymer-composites, metals, ceramics, wood, paper-based composite or laminate. Functional components can be molded or shaped into the scroll element to improve direction of fluids into the outlet opening 28. In at least one example, the housing wall 32 can be shaped to operate as a scroll element for directing the fluid through the outlet opening 28.

In an example, the ventilation assembly 20 can be used to ventilate any room, area or space. In at least one example, the ventilation assembly 20 can be secured within an intermediate space, outside of the room, area or space, and coupled with one or more ventilation duct assemblies to provide ventilation to the room, area or space.

In an example, a method for installing a ventilation assembly 20 can include providing a main housing 24 having a housing wall 32 defining an interior space and an inlet opening 26 for accessing the interior space. The method can also include providing a fan assembly 22 including a fan 30 mounted to a motor mount plate 42, the motor mount plate 42 can include a releasable mount 60. The method can include positioning the main housing 24 within an aperture in a building structure, wherein main housing 24 is oriented such that the inlet opening 26 faces the aperture. The method includes inserting the fan assembly 22 through the inlet opening 26 such that the mount motor plate 42 engages the housing wall 32. In at least one example, the fan assembly 22 is inserted into the main housing 24 prior to positioning of the main housing 24 within the aperture in the building structure. In at least one example, the fan assembly 22 is inserted into the main assembly 24 after the positioning of the main housing 24 within the aperture in the building structure, wherein the fan assembly 22 is inserted through the aperture and the inlet opening 26 into the interior space.

As depicted in FIGS. 6A-6B, the method can further include providing an accessory component 50 having an accessory mount 52. The motor mount plate 54 can include a positioning mount 54. The method can further include releasably engaging the accessory mount 52 to the positioning mount 54 to retain the accessory component 50 on the motor mount plate 54. The method can further include inserting a fastener through a tab portion 59 of the accessory component 50 to fix the accessory component 50 to the motor mount plate 54. In at least one example, the accessory component 50 can be mounted to the fan assembly 22 prior to mounting of the fan assembly 22 within the main housing 24. In at least one example, the accessory component 50 can be mounted to the fan assembly 22 after to mounting of the fan assembly 22 within the main housing 24, wherein the accessory component 50 is inserted through the inlet opening 26 to mount the accessory component 50 to the motor mount plate 54.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A method of mounting a ventilation assembly, comprising:

providing a main housing having a housing wall defining an interior space and an inlet opening;

providing a fan assembly including a fan and a motor mount plate;

positioning the main housing within an aperture of a building structure such that the inlet opening faces the aperture;

inserting the fan assembly through the inlet opening such that the motor mount plate engages the housing wall;

providing an accessory component having an accessory mount, the motor mount plate including a positioning mount; and releasably engaging the accessory mount to the positioning mount to position the accessory component against the motor mount plate, wherein the accessory mount includes a hook element insertable into a receptacle defined by the positioning mount to releasably engage the accessory component to the motor mount plate.

2. The method of claim 1, further comprising:

inserting at least one fastener through a releasable mount of the motor mount plate to secure the fan assembly within the interior space.

3. The method of claim 2, further comprising:

removing each fastener inserted through the releasable mount; and withdrawing the fan assembly from the interior space through the inlet opening.

4. The method of claim 3, further comprising:

providing a second fan assembly including a second fan and a second motor mount plate;

inserting the second fan assembly through the inlet opening such that the second motor mount plate engages the housing wall; and inserting at least one fastener through a second releasable mount of the second motor mount plate to secure the second fan assembly within the interior space.

5. The method of claim 1, further comprising:

inserting at least one fastener through the accessory mount to secure the accessory component to the motor mount plate.

6. The method of claim 5, further comprising:

removing each fastener inserted through the accessory mount; and disengaging the accessory mount from the motor mount plate.

7. The method of claim 1, further comprising:

providing a second accessory component having a second accessory mount;

releasably engaging the second accessory mount to the positioning mount to position the second accessory component against the motor mount plate; and inserting at least one fastener through the second accessory mount to secure the second accessory component to the motor mount plate.

8. A ventilation assembly, comprising:

a main housing having a housing wall defining an interior space and an inlet opening, wherein the inlet opening corresponds to the cross-sectional area of the interior space defined by the housing wall;

a fan assembly including a fan and a motor mount plate having a releasable mount; and an accessory component having an accessory mount;

wherein the fan assembly is insertable through the inlet opening such that the motor mount plate engages the housing wall, the releasable mount being configured to receive at least one fastener to engage the fan assembly to the main housing, wherein the motor mount plate includes a positioning mount engagable to the accessory mount to retain the accessory component proximate the motor mount plate, and wherein the accessory mount includes a hook element insertable into a corresponding receptacle of the motor mount plate to position the accessory component proximate the motor mount plate.

9. The ventilation assembly of claim 8, wherein the releasable mount is positioned on the motor mount plate such that the releasable mount and each corresponding fastener is accessible through the inlet opening when the fan assembly is fixed within the main housing.

10. The ventilation assembly of claim 9, further comprising:

a second fan assembly including a second fan and a second motor mount plate having a second releasable mount;

wherein the fasteners fixing the fan assembly are removable such that the second fan assembly is removable from the main housing through the inlet opening and the second fan assembly is insertable into the main housing through the inlet opening.

11. The ventilation assembly of claim 8, wherein the accessory component is configured to receive at least one fastener to mount the accessory component to the motor mount plate;

wherein the engagement of the accessory mount and the positioning mount maintain the position of the accessory component during insertion of the fastener.

12. The ventilation assembly of claim 11, further comprising:

a second accessory component having a second accessory mount;

wherein each fastener is removable from the accessory mount to disengage the accessory mount from the positioning mount such that the second accessory mount can be engaged to the motor mount plate.

13. A ventilation assembly kit, comprising:

a main housing having a housing wall defining an interior space and an inlet opening, wherein the inlet opening corresponds to the cross-sectional area of the interior space defined by the housing wall;

a fan assembly including a fan and a motor mount plate having a releasable mount and a positioning mount, wherein the releasable mount is configured to receive at least one fastener to mount the fan assembly to the main housing; and an accessory component having an accessory mount engagable to the positioning mount, wherein the accessory mount includes a hook element insertable into a corresponding receptacle of the motor mount plate to position the accessory component proximate the motor mount plate.

14. The ventilation assembly kit of claim 13, wherein the accessory mount is configured to receive at least one fastener to mount the accessory component to the motor mount plate.

15. A method of mounting a ventilation assembly, comprising:

providing a main housing having a housing wall defining an interior space and an inlet opening;

providing a fan assembly including a fan and a motor mount plate, wherein the motor mount plate includes a positioning mount;

providing an accessory component having an accessory mount;

inserting the fan assembly through the inlet opening such that the motor mount plate engages the housing wall;

positioning the main housing within an aperture of a building structure such that the inlet opening faces the aperture;

inserting the accessory component through the inlet opening; and releasably engaging the accessory mount to the positioning mount to position the accessory component against the motor mount plate, wherein the accessory mount includes a hook element insertable into a receptacle defined by the positioning mount to releasably engage the accessory component to the motor mount plate.

16. The method of claim 15, further comprising:

inserting at least one fastener through a releasable mount of the motor mount plate to secure the fan assembly within the interior space.

17. The method of claim 15, further comprising:

inserting at least one fastener through the accessory mount to secure the accessory component to the motor mount plate.

18. The method of claim 17, further comprising:

removing each fastener inserted through the accessory mount; and disengaging the accessory mount from the motor mount plate.

19. The method of claim 18, further comprising:

providing a second accessory component having a second accessory mount;

releasably engaging the second accessory mount to the positioning mount to position the second accessory component against the motor mount plate; and inserting at least one fastener through the second accessory mount to secure the second accessory component to the motor mount plate.

20. A ventilation assembly, comprising:

a main housing having a housing wall defining an interior space and an inlet opening, wherein the inlet opening corresponds to the cross-sectional area of the interior space defined by the housing wall; and a fan assembly including a fan and a motor mount plate having a releasable mount and a positioning mount, wherein the fan assembly is insertable through the inlet opening such that the motor mount plate engages the housing wall, the releasable mount being configured to receive at least one fastener to engage the fan assembly to the main housing; and an accessory component having an accessory mount engagable to the positioning mount to retain the accessory component proximate the motor mount plate, wherein the accessory mount includes a hook element insertable into a corresponding receptacle of the motor mount plate to position the accessory component proximate the motor mount plate.

21. The ventilation assembly of claim 20, wherein the releasable mount is positioned on the motor mount plate such that the releasable mount and each corresponding fastener is accessible through the inlet opening when the fan assembly is fixed within the main housing.

22. The ventilation assembly of claim 20, wherein the accessory component is configured to receive at least one fastener to mount the accessory component to the motor mount plate;

wherein the engagement of the accessory mount and the positioning mount maintain the position of the accessory component during insertion of the fastener.

23. The ventilation assembly of claim 20, further comprising:

a second accessory component having a second accessory mount;

wherein each fastener is removable from the accessory mount to disengage the accessory mount from the positioning mount such that the second accessory mount can be engaged to the motor mount plate.

* * * * *